US009647354B1

(12) United States Patent
Rao et al.

(10) Patent No.: US 9,647,354 B1
(45) Date of Patent: May 9, 2017

(54) TERMINAL BLOCK SPLITTER CONNECTOR

(71) Applicant: Jiang Men Top Electric Intelligence Co., Ltd, Guangdong (CN)

(72) Inventors: Xiaopo Rao, Guangdong (CN); Boqing Yin, Guangdong (CN)

( * ) Notice: Subject to any disclaimer, the term of this patent is extended or adjusted under 35 U.S.C. 154(b) by 0 days.

(21) Appl. No.: 15/141,828

(22) Filed: Apr. 29, 2016

(30) Foreign Application Priority Data

Mar. 30, 2016 (CN) ..... 2016 1 0191569

(51) Int. Cl.
*H01R 9/22* (2006.01)
*H01R 9/24* (2006.01)
*H01R 4/28* (2006.01)

(52) U.S. Cl.
CPC ..... *H01R 9/2475* (2013.01); *H01R 4/28* (2013.01)

(58) Field of Classification Search
CPC ..... H01R 9/2475; H01R 4/28
USPC ..... 439/709–722
See application file for complete search history.

(56) References Cited

U.S. PATENT DOCUMENTS 4,817,283 A * 4/1989 Johnston ..... H01R 43/16 29/883
4,904,209 A * 2/1990 Nelson ..... H01R 24/62 439/638
5,199,896 A * 4/1993 Mosquera ..... H01R 12/714 29/842
5,759,067 A * 6/1998 Scheer ..... H01R 13/6641 439/607.26
6,328,595 B1 * 12/2001 Chang ..... H01R 13/6641 439/490
6,514,086 B2 * 2/2003 Liao ..... H01R 13/6469 439/638
6,641,443 B1 * 11/2003 Itano ..... H01R 13/6474 439/676
9,437,940 B1 * 9/2016 Rao ..... H01R 4/4836

* cited by examiner

*Primary Examiner* — Khiem Nguyen
(74) *Attorney, Agent, or Firm* — Prakash Nama; Global IP Services, PLLC

(57) ABSTRACT

The invention relates to a terminal block splitter connector including an insulating housing, the first conductive metal component, the second conductive metal component, the first fixing component, the second fixing component, the first wire inlet group, the second wire inlet group, the first push button, and the second push button. The first and second push button match with the first and second conductive metal component for on-line and off-line control of the first and second conductive metal component. A conductive connection plate is installed on the bottom of the insulating housing for power connection of the first and second conductive metal component. The first and second pin group are respectively mounted on the bottom of the first and second conductive metal component. The first and second socket group are installed on the conductive connection plate and respectively correspond to the first and second pin group.

8 Claims, 35 Drawing Sheets

TERMINAL BLOCK SPLITTER CONNECTOR

BACKGROUND OF THE INVENTION

The invention related to the technical field of terminal block structure, in particular a terminal block splitter connector with one pair of wire in and multiple pairs of wire out, wherein the terminal is plug-type and the on-line and off-line control are realized through push button.

Terminal block is taken as connect components to effectively connect and electrify electronic components and electrical appliance. The terminal block is also taken as an important wire connection parts for the connection of electrical appliances and the connection among terminal blocks. But, the structure of existing terminal blocks are in various forms. Wire connection cannot be completed in one step. It often requires to take terminal blocks apart and connect the wire to the terminal blocks by the use of bolts and rivets. The installation and connection are extremely complex and arduous. The process of wire connection is added. The efficiency of wire connection is reduced. The intensity of labor is increased. In case of terminal blocks with wires, it needs to take wires from the terminal block, take terminal blocks apart, loosen fastener, and separate wires from the conducting strip of terminal blocks. The entire operation is very inconvenient. Especially for wire connection of the existing electrical appliances or electronic components, at least two terminal blocks match with each other to realize connection of hard wire and soft wire or multiple wires. That the two terminal blocks are unable to be connected in one shot is rather cumbersome. In case wire is required to be connected in the construction site with large amount of work, the tedious wiring process will take considerable manpower cost and time, not conducive to reduce cost and labor intensity.

Although connecting members like terminal blocks with one-time connection are developed, there are drawbacks, such as complex structure, inconvenient processing and production, and higher cost. Besides, the effect of wire connection is unsatisfactory. Unstable wire connection is easy to cause off-line accident. The wire cannot be connected quickly. The service life is not long. In particular, the fast connection of two terminal blocks through the connection of hard wire and soft wire, or the structure of terminal blocks with fast connection through one terminal block directly connected with electrical appliance is never appeared.

BRIEF SUMMARY OF THE INVENTION

The present invention is to overcome deficiencies of the current technologies and provide a terminal block splitter connector with one pair of wire in and multiple pairs of wire out, wherein the terminal is plug-type and the on-line and off-line control are realized through push button. The input of multiple pairs of soft wires or hard wires or output of 1 pair of soft wires or hard wires is realized, which is to say, both ends of terminal block splitter connector are able to connect with soft wires and hard wires. In terms of on-line and off-line control, the push button required for wire connection is pressed down. The pressing end of push button is to press the elastic metal sheet and a certain gap is formed between the elastic metal sheet and the metal frame. Wire is inserted into the gap from wire inlet. The push button is loosened and elastic metal sheet returns to press wire together with the metal frame. Wire is firmly connected. It is unnecessary to take terminal blocks apart. One-time connection is realized. The operation is simple, convenient, and in high efficiency. The push button is pressed down to complete off-line control. It is very easy.

The technical solution included in the invention is as follows: A terminal block splitter connector including an insulating housing, and the first and second conductive metal component installed in the insulating housing, wherein the insulating housing is equipped with the first and second fixing component respectively for fixing the first and second conductive metal component. The first wire inlet group is arranged on the front end of the insulating housing and corresponds to the first fixing component and the first conductive metal component. The second wire inlet group is arranged on the rear end of the insulating housing and corresponds to the second fixing component and the second conductive metal component. The first and second push button pass through the top end of the insulating housing and correspond to the first and second conductive metal component respectively. The first and second push button match with the first and second conductive metal component for on-line and off-line control of the first and second conductive metal component. There are at least 2 groups of the first conductive metal components and 1 group of the second conductive metal component. A conductive connection plate is installed on the bottom of the insulating housing for power connection of the first and second conductive metal component. The first and second pin group are respectively mounted on the bottom of the first and second conductive metal component. The first and second socket group are installed on the conductive connection plate and respectively correspond to the first and second pin group. An anti-reverse installation structure is arranged on both sides or front or rear end of the conductive connection plate for anti-reverse installation.

Further, as an anti-reverse connection plate to connect the first socket group with the second socket group, the anti-reverse installation structure should take different shapes on both sides for anti-reverse installation.

Further, one side of the anti-reverse connection plate is tilt and the other of which is straight.

Further, the first conductive metal component is composed of two of the first metal frames which are symmetrical and arranged side-by-side. The first metal frame is hollow. One end of the first metal frame corresponding to the first wire inlet group is equipped with the first elastic metal sheet which is up from bottom and turned over in the first metal frame to be closely attached with the top end of the first metal frame. The first gap mounted on the top end of the first metal frame allows the pressing end of the first push button to be passed and is able to press the first elastic metal sheet down. The second conductive metal component is composed of two of the second metal frames which are symmetrical and arranged side-by-side. The second metal frame is hollow. One end of the second metal frame corresponding to the second wire inlet group is equipped with the second elastic metal sheet which is up from bottom and turned over in the second metal frame to be closely attached with the top end of the second metal frame. The second gap mounted on the top end of the second metal frame allows the pressing end of the second push button to be passed and is able to press the second elastic metal sheet down. The first pin group consists of the first pins respectively mounted on two of the first metal frame groups. Two of the first pins are installed on the bottom of each the first metal frame group. The first pin and the first metal frame group are integrated. The second pin group consists of the second pins respectively mounted on two of the second metal frame groups. Two of the second pins are installed on the bottom of each the second metal frame group. The second pin and the second metal frame group are integrated.

Further, the insulating housing consists of upper housing and lower housing. The conductive connection plate, the first and second fixing component are installed in the lower housing. The first and second push button are arranged on and integrated with the upper housing. The first and second push button and the insulating housing are combined into a flexible built-in button structure. The first fixing component consists of two of the first card boards, a rectangular slot block, and the second card boards. The first card boards are respectively arranged on both sides and erected to separate two of symmetrically side-by-side the first metal frames without direct contact. The rectangular slot block is gradually moving closer to the center from two of the first card boards on both sides and is sequentially staggered at intervals. Two rectangular slot blocks and the second card boards between them are to separate symmetrically side-by-side the first metal frame without direct contact. The second fixing component consists of three upright baffles which separate symmetrically side-by-side the second metal frame without direct contact.

Or, the insulating housing consists of front housing and rear housing. Conductive connection plate and the second fixing component are arranged in the front housing. The first fixing component is arranged on the rear housing. The first fixing component is composed of the first straight slot on the upper part and the first baffle on the lower part. The first baffle is to separate two of symmetrically side-by-side the first metal frames without direct contact. The upper housing is equipped with the first button installation slot corresponding to the first straight slot. The first push button passes through the first button installation slot and the first straight slot to press the first metal frame. The second fixing component is composed of the second straight slot on the upper part and the second baffle on the lower part. The second baffle is to separate two of symmetrically side-by-side the second metal frames without direct contact. The upper housing is equipped with the second button installation slot corresponding to the second straight slot. The second push button passes through the second button installation slot and the second straight slot to press the second metal frame. The first and second push button and the upper housing is able to form an independently arranged or installed independent button. The first and second push button are inverted U-type and provided with two pressing ends downwards.

Further, the conductive connection plate is powered in parallel or serial.

Further, there are 3, 6, or 9 groups of the first conductive metal components and 1 group of the second conductive metal component.

Overall, the invention has the advantages that: the terminal block splitter connector with one pair of wire in and multiple pairs of wire out, wherein the terminal is plug-type and the on-line and off-line control are realized through push button. The input of multiple pairs of soft wires or hard wires or output of 1 pair of soft wires or hard wires is realized, which is to say, both ends of terminal block splitter connector are able to connect with soft wires and hard wires. In terms of on-line and off-line control, the push button required for wire connection is pressed down. The pressing end of push button is to press the elastic metal sheet and a certain gap is formed between the elastic metal sheet and the metal frame. Wire is inserted into the gap from wire inlet. The push button is loosened and elastic metal sheet returns to press wire together with the metal frame. Wire is firmly connected. It is unnecessary to take terminal blocks apart. One-time connection is realized. The operation is simple, convenient, and in high efficiency. The push button is pressed down to complete off-line control. It is very easy.

DETAILED DESCRIPTION OF THE INVENTION

Embodiment 1

Figure 1:
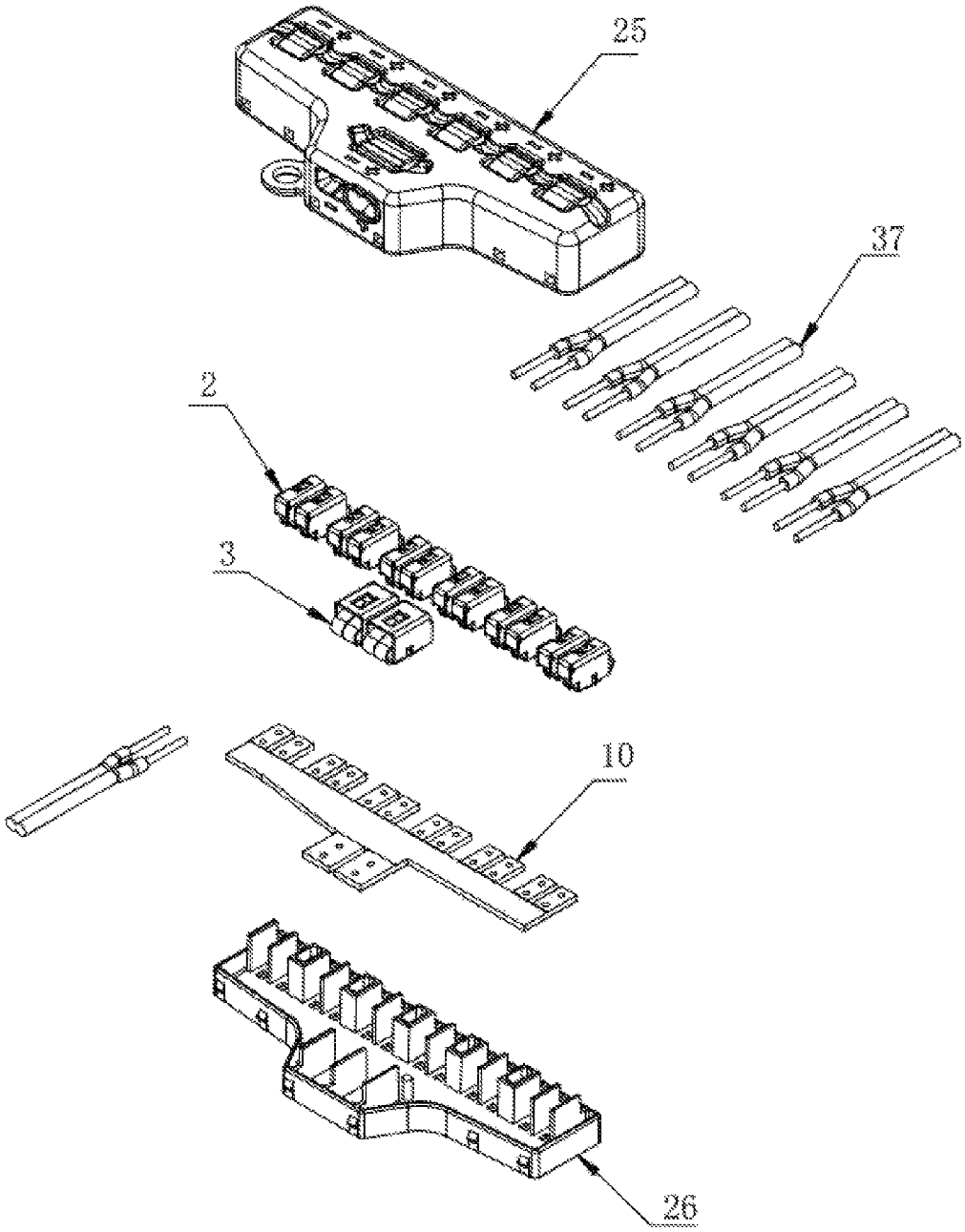
FIG. 1: Structure Decomposition Map for Connecting of A Terminal Block Splitter Connector with Wire in Embodiment 1 of the Invention
Figure 2:
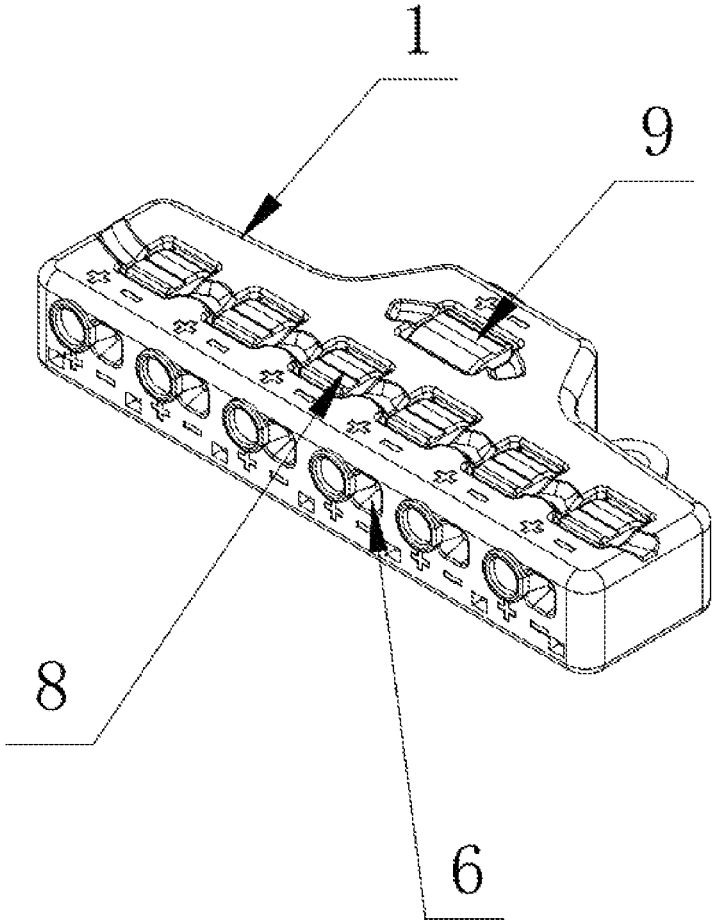
FIG. 2: Structure Diagram of A Terminal Block Splitter Connector in Embodiment 1 of the Invention
Figure 3:
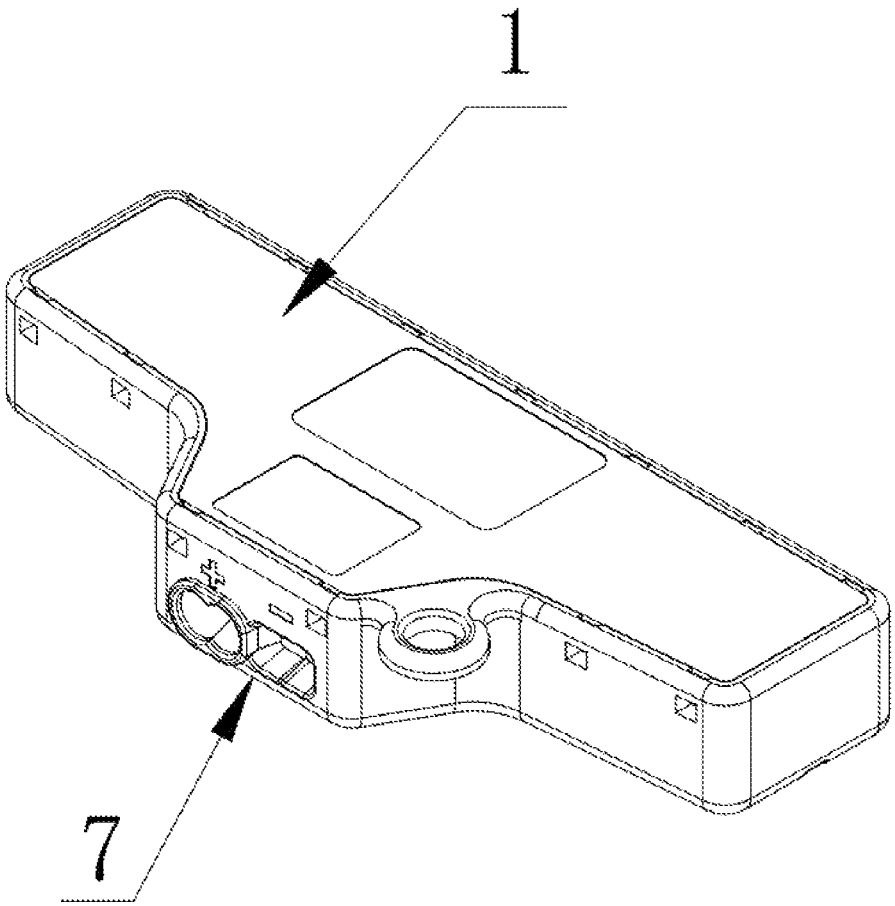
FIG. 3: Structure Diagram For Another Direction of A Terminal Block Splitter Connector in Embodiment 1 of the Invention
Figure 4:
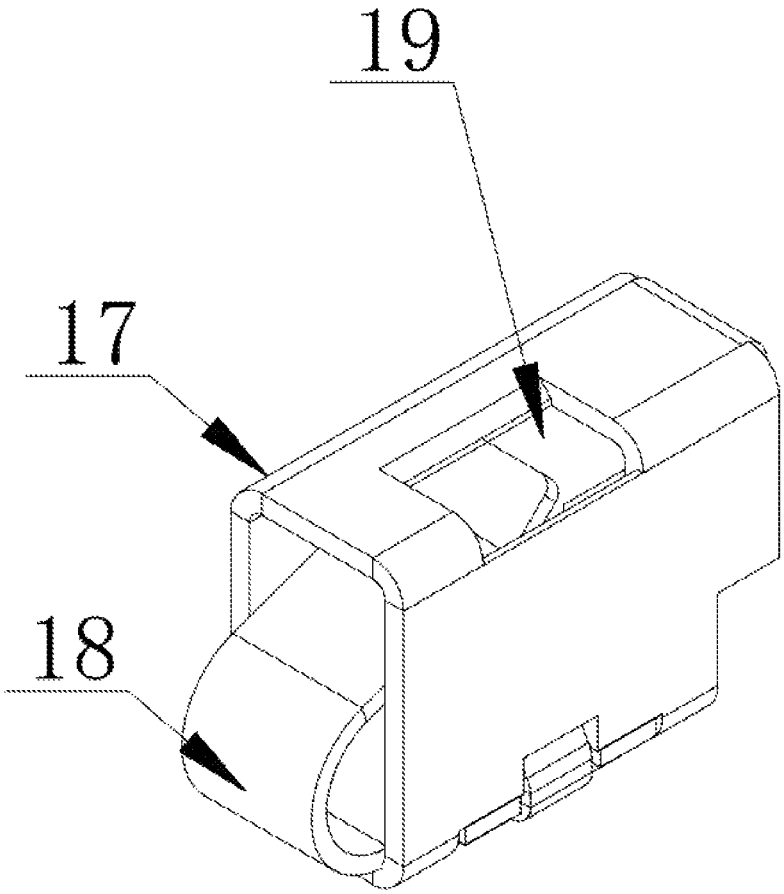
FIG. 4: Structure Diagram of the First Conductive Metal Component in Embodiment 1 of the Invention
Figure 5:
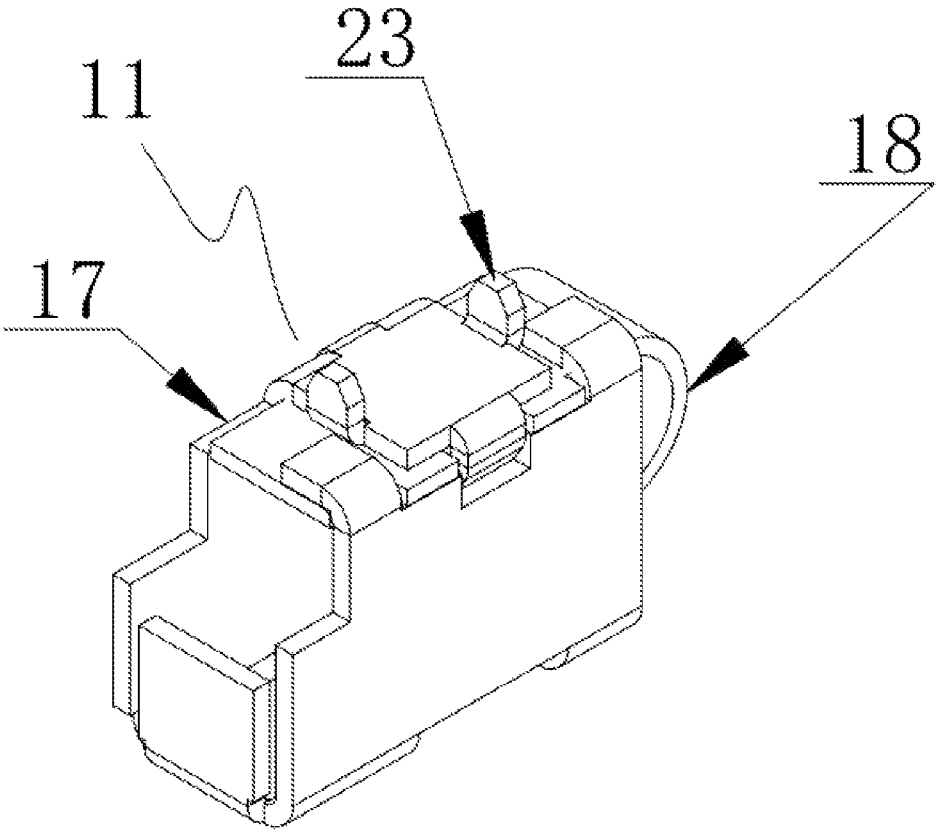
FIG. 5: Structure Diagram for Another Direction of the First Conductive Metal Component in Embodiment 1 of the Invention
Figure 6:
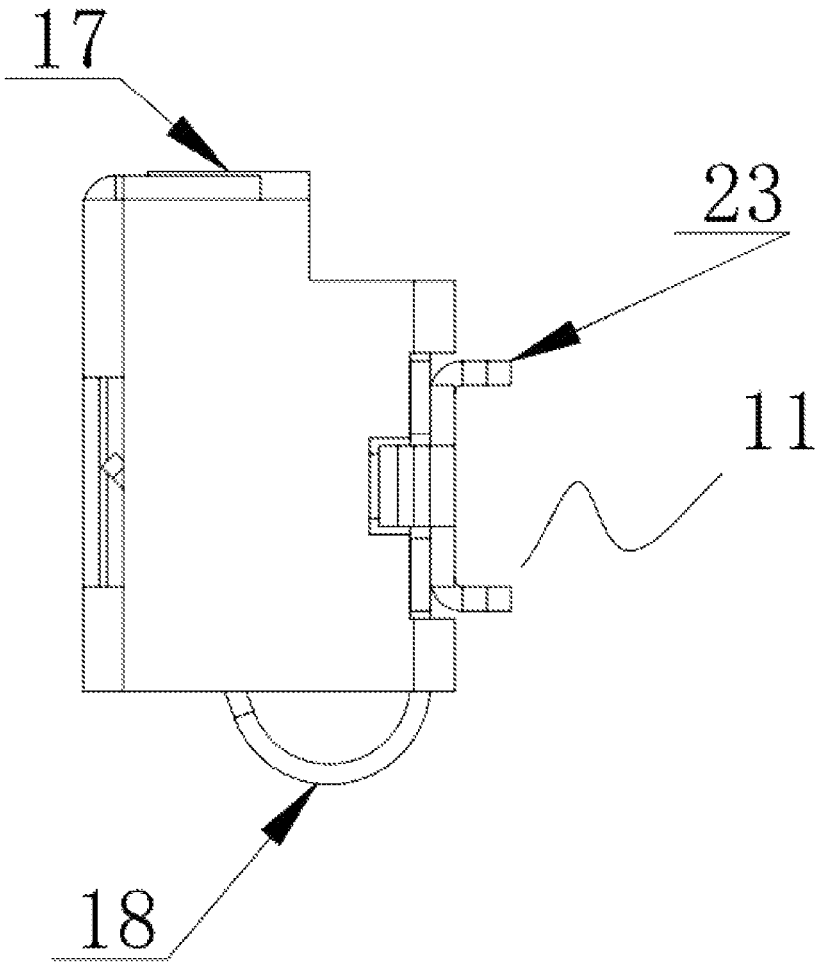
FIG. 6: Right View of the First Conductive Metal Component in Embodiment 1 of the Invention
Figure 7:
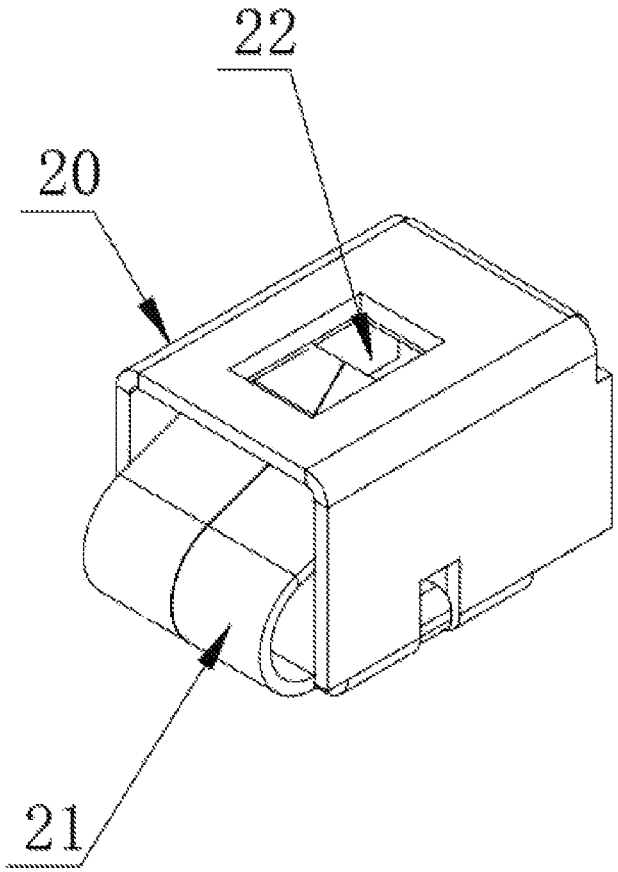
FIG. 7: Structure Diagram of the Second Conductive Metal Component in Embodiment 1 of the Invention
Figure 8:
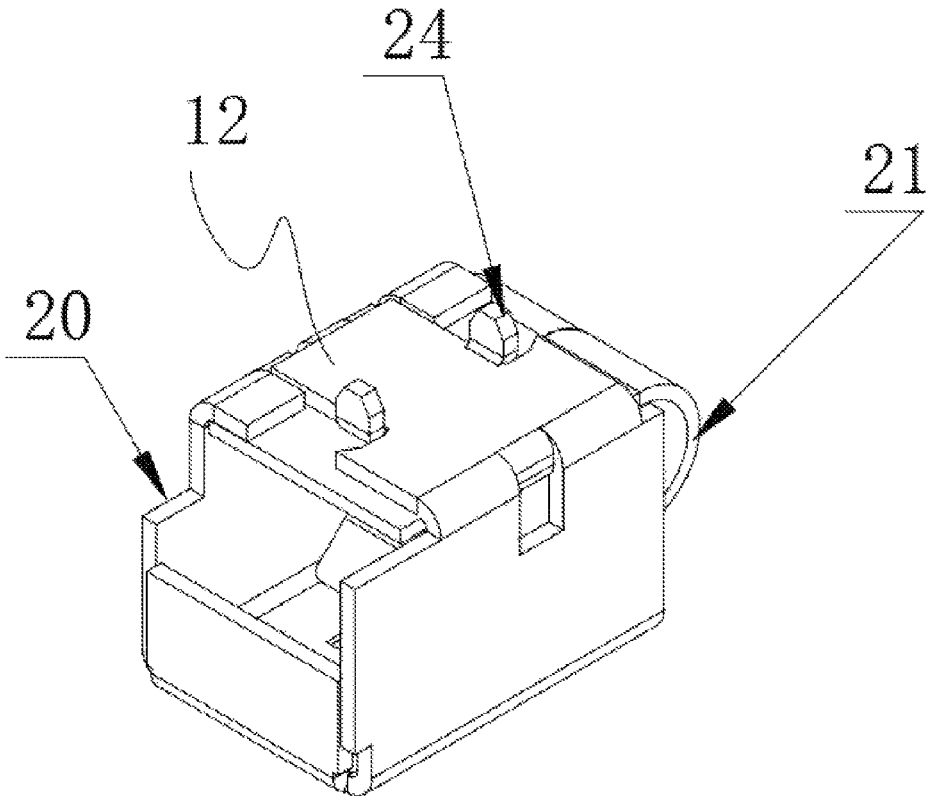
FIG. 8: Structure Diagram for Another Direction of the Second Conductive Metal Component in Embodiment 1 of the Invention
Figure 9:
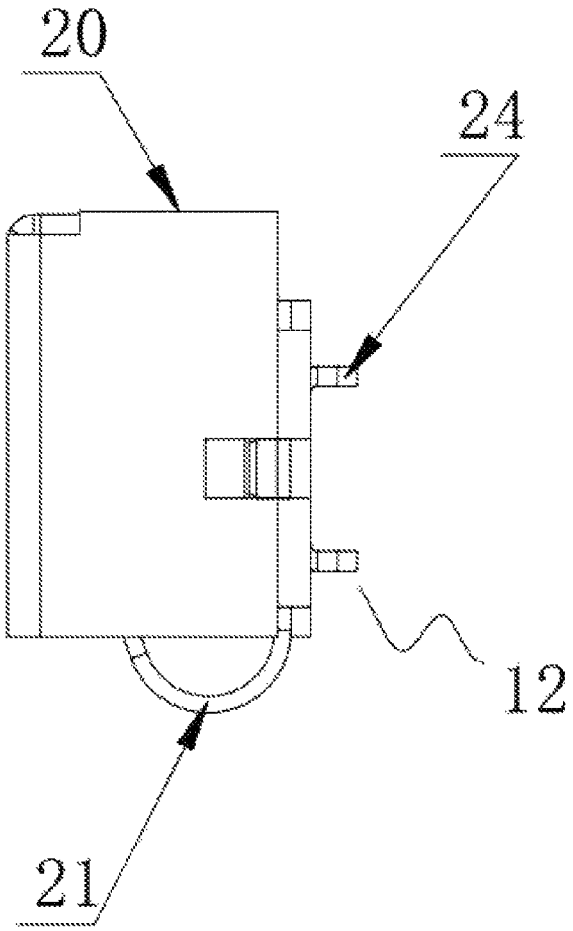
FIG. 9: Right View of the Second Conductive Metal Component in Embodiment 1 of the Invention
Figure 10:
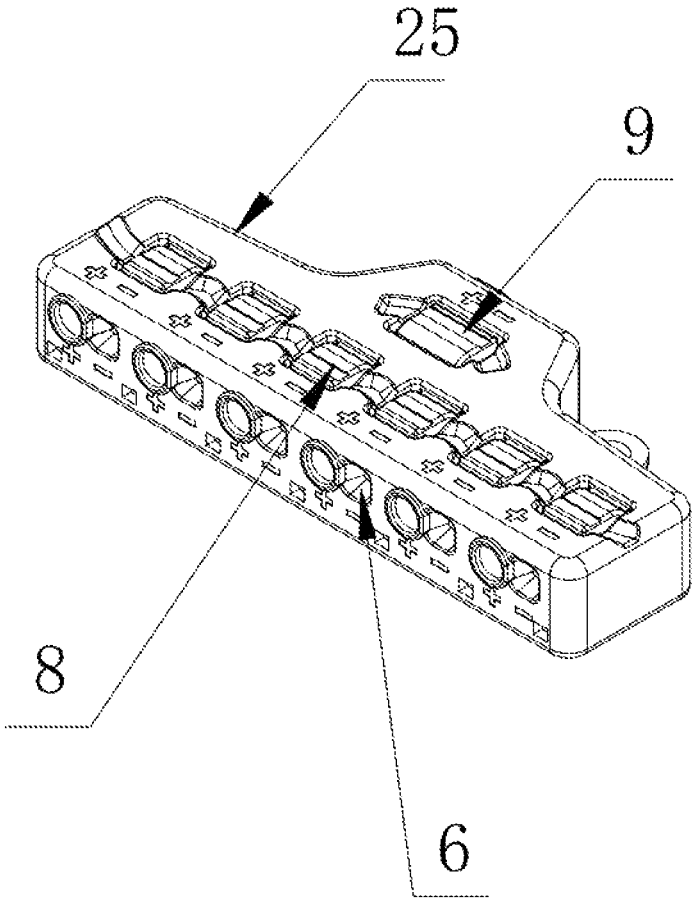
FIG. 10: Structure Diagram of Upper Housing in Embodiment 1 of the Invention
Figure 11:
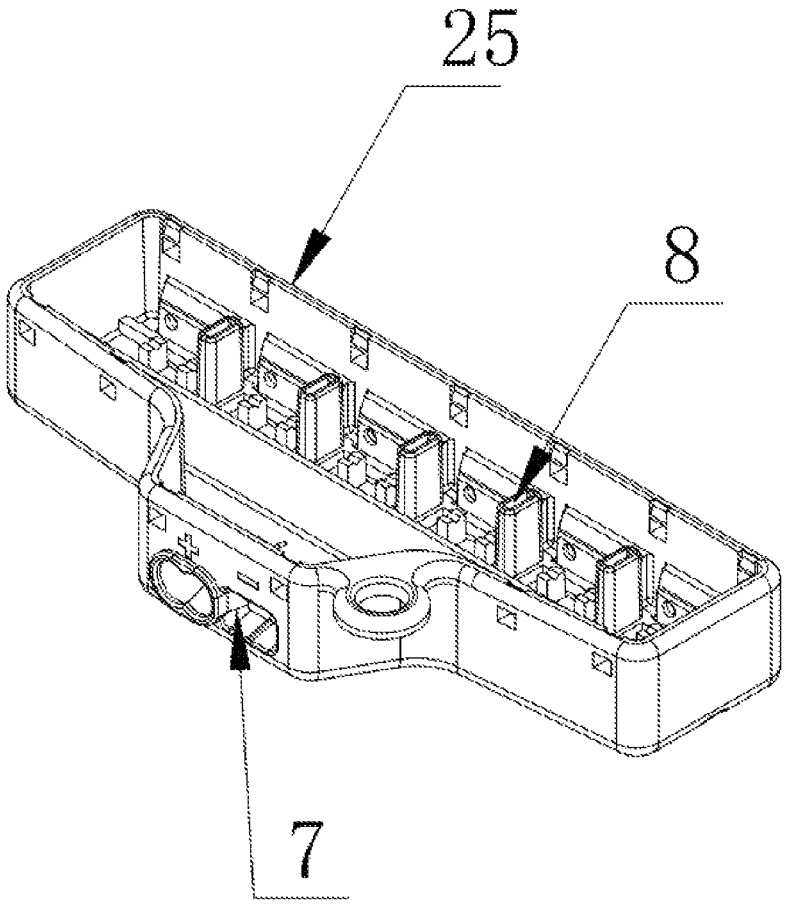
FIG. 11: Structure Diagram for Another Direction of Upper Housing in Embodiment 1 of the Invention
Figure 12:
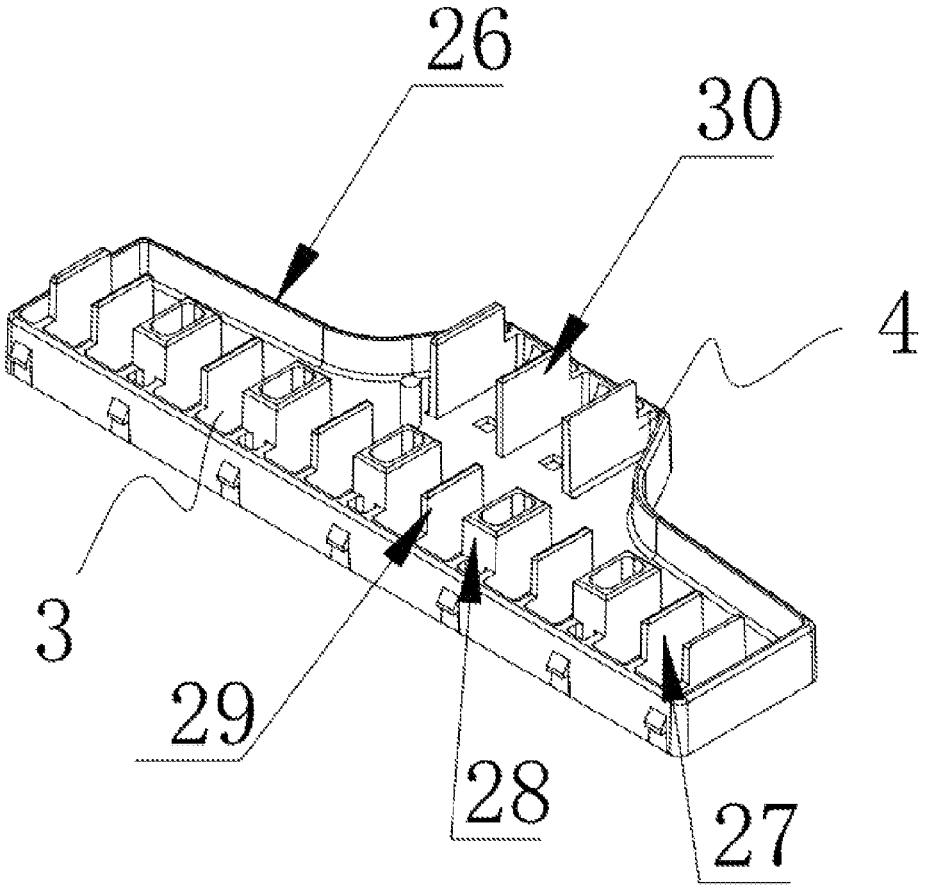
FIG. 12: Structure Diagram of Lower Housing in Embodiment 1 of the Invention
Figure 13:
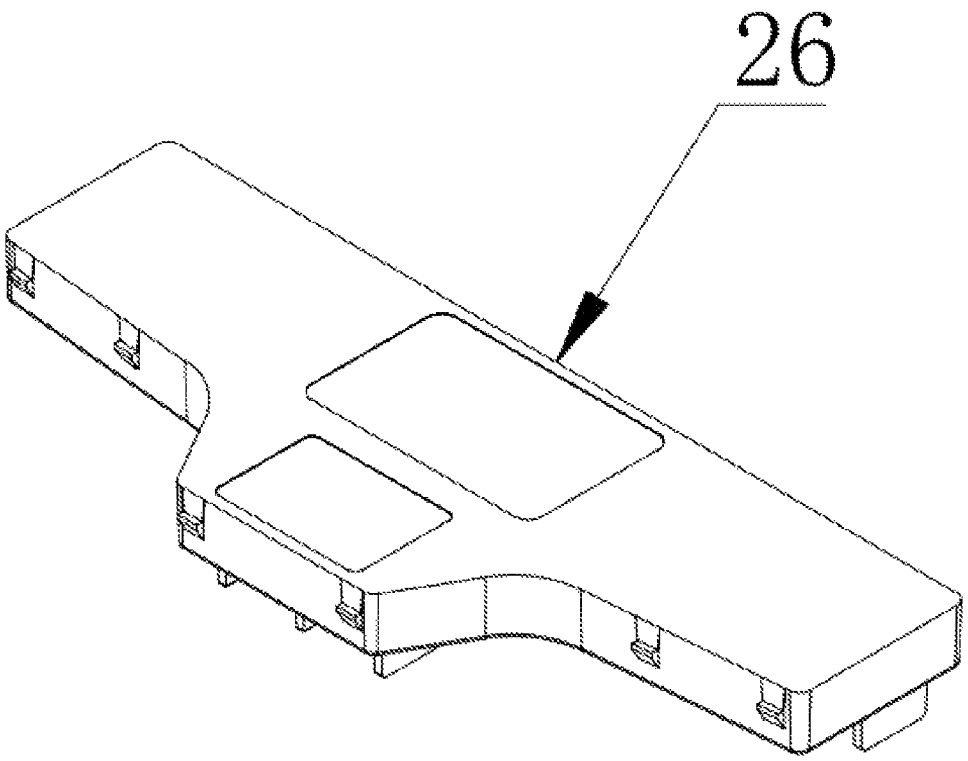
FIG. 13: Structure Diagram for Another Direction of Lower Housing in Embodiment 1 of the Invention
Figure 14:
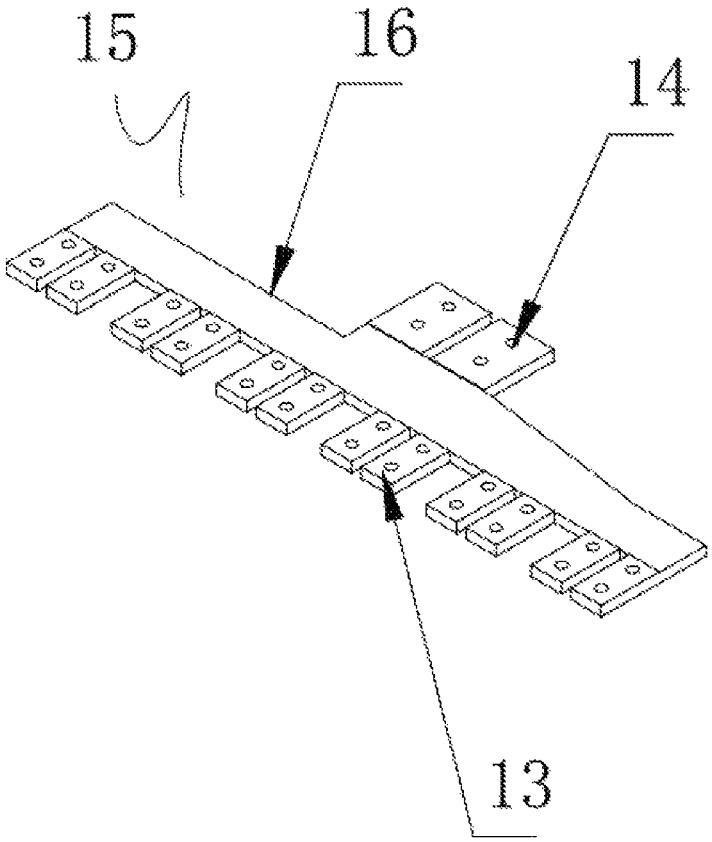
FIG. 14: Structure Diagram of Conductive Connection Plate in Embodiment 1 of the Invention
Figure 15:
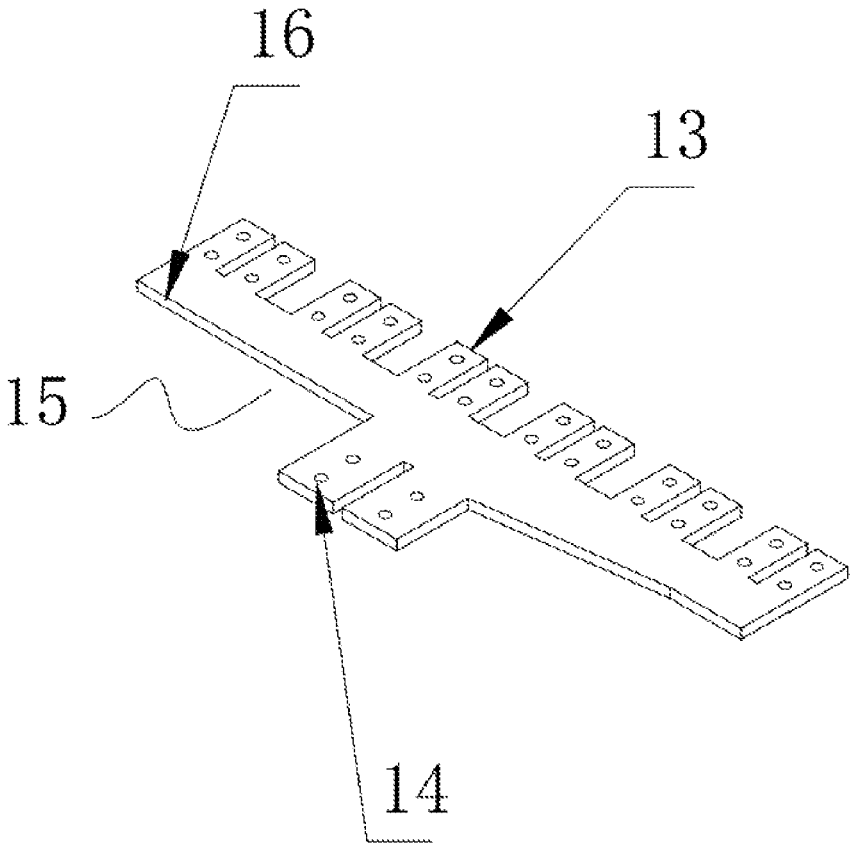
FIG. 15: Structure Diagram for Another Direction of Conductive Connection Plate in Embodiment 1 of the Invention
Figure 16:
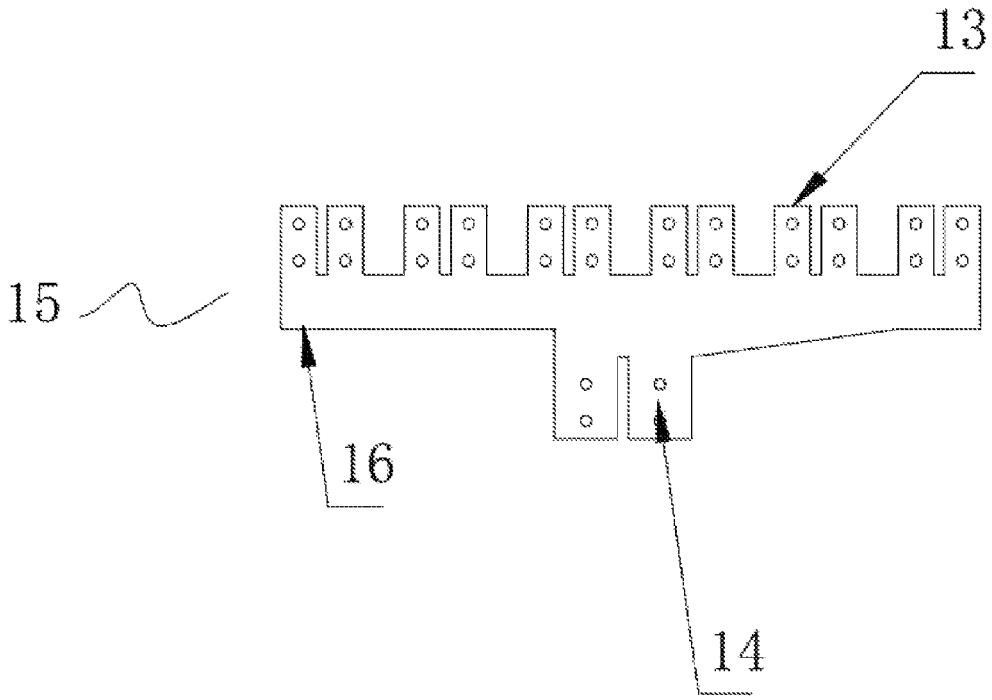
FIG. 16: Main View of Conductive Connection Plate in Embodiment 1 of the Invention
Figure 17:
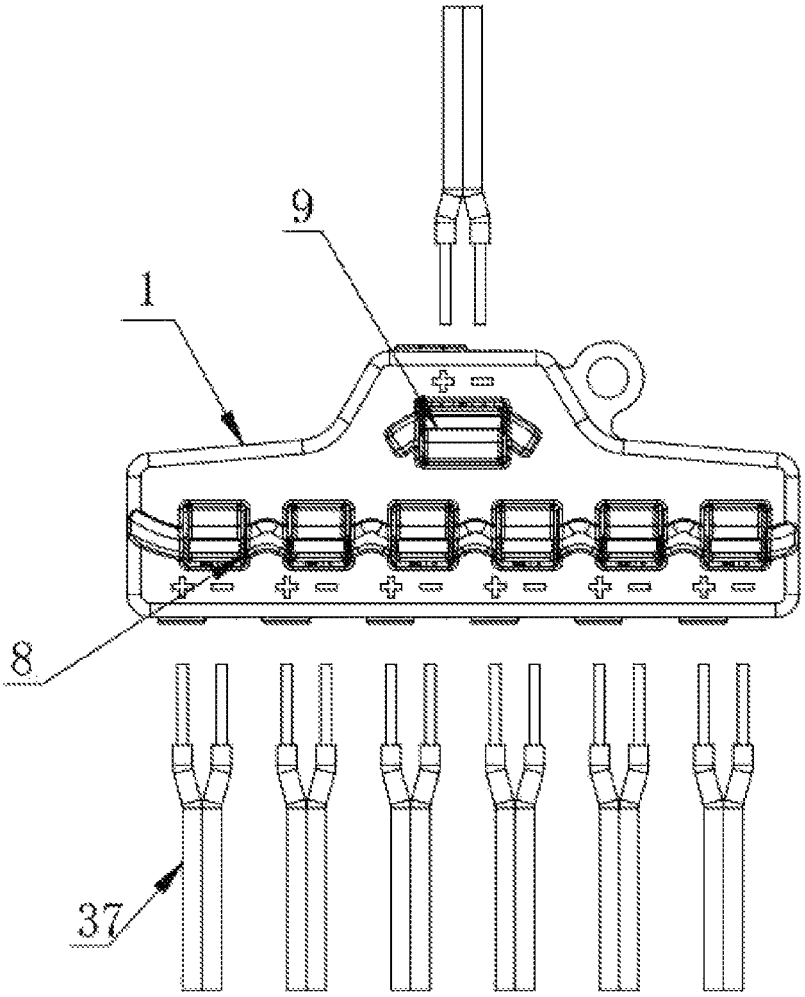
FIG. 17: Structure Diagram for Connecting of A Terminal Block Splitter Connector with Wire in Embodiment 1 of the Invention
Figure 18:
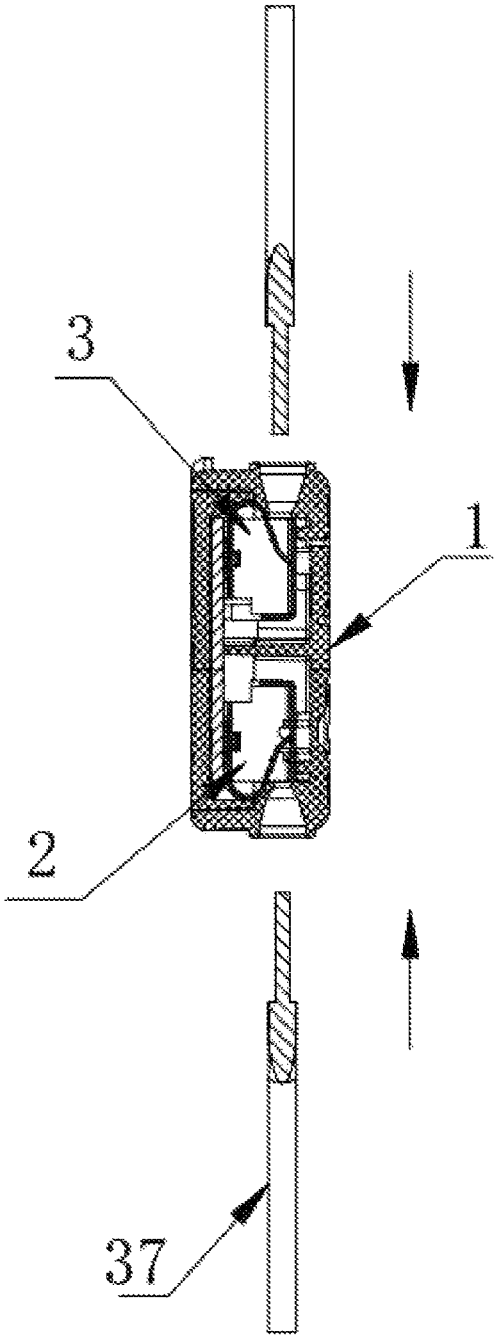
FIG. 18: Longitudinal Cross-Sectional View for Connecting of A Terminal Block Splitter Connector with Wire in Embodiment 1 of the Invention
Figure 19:
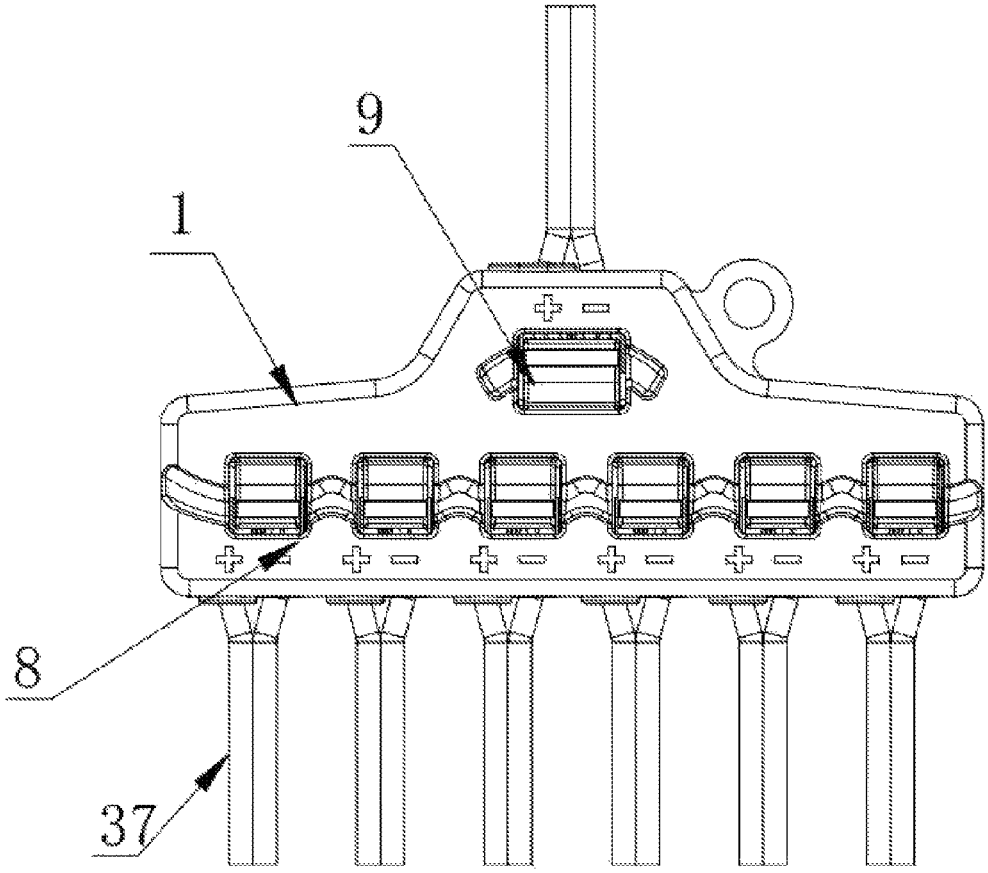
FIG. 19: Structure Diagram for Connected Terminal Block Splitter Connector and Wire in Embodiment 1 of the Invention
Figure 20:
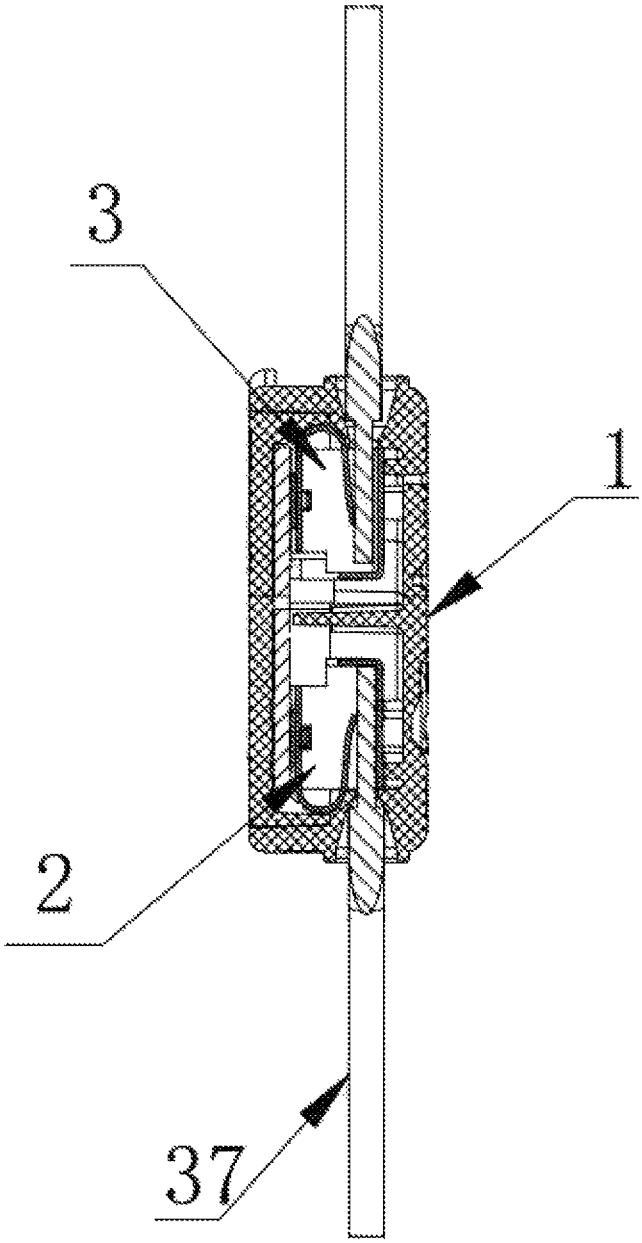
FIG. 20: Longitudinal Cross-Sectional View for Connected Terminal Block Splitter Connector and Wire in Embodiment 1 of the Invention
Figure 21:
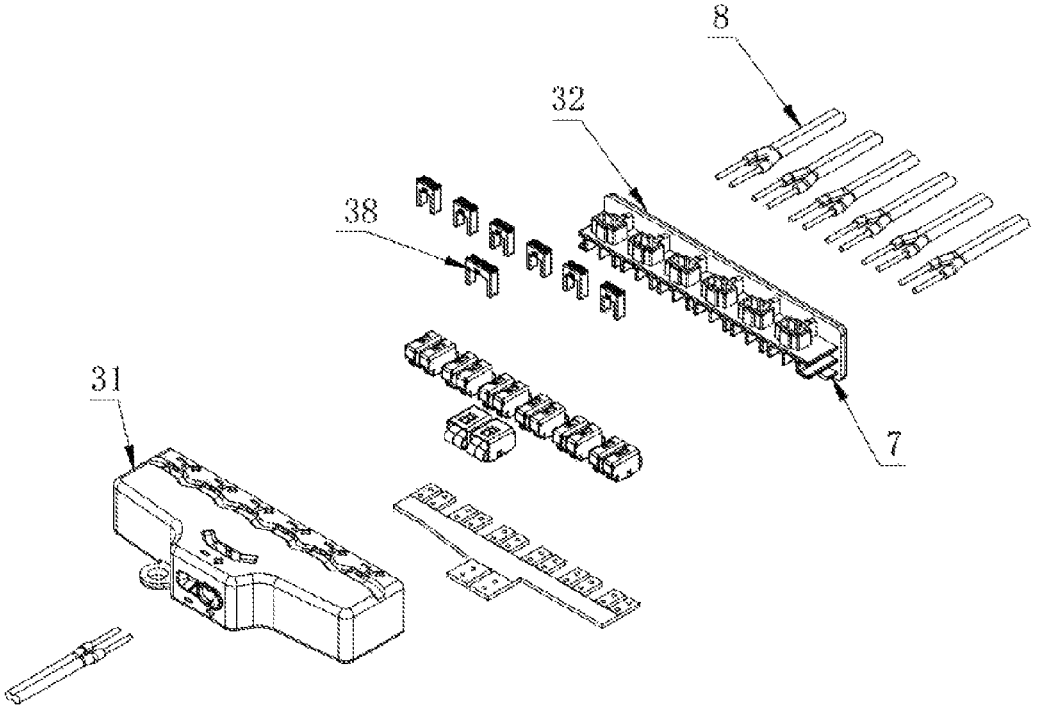
FIG. 21: Structure Decomposition Map for Connecting A Terminal Block Splitter Connector with Wire in Embodiment 1 of the Invention
Figure 22:
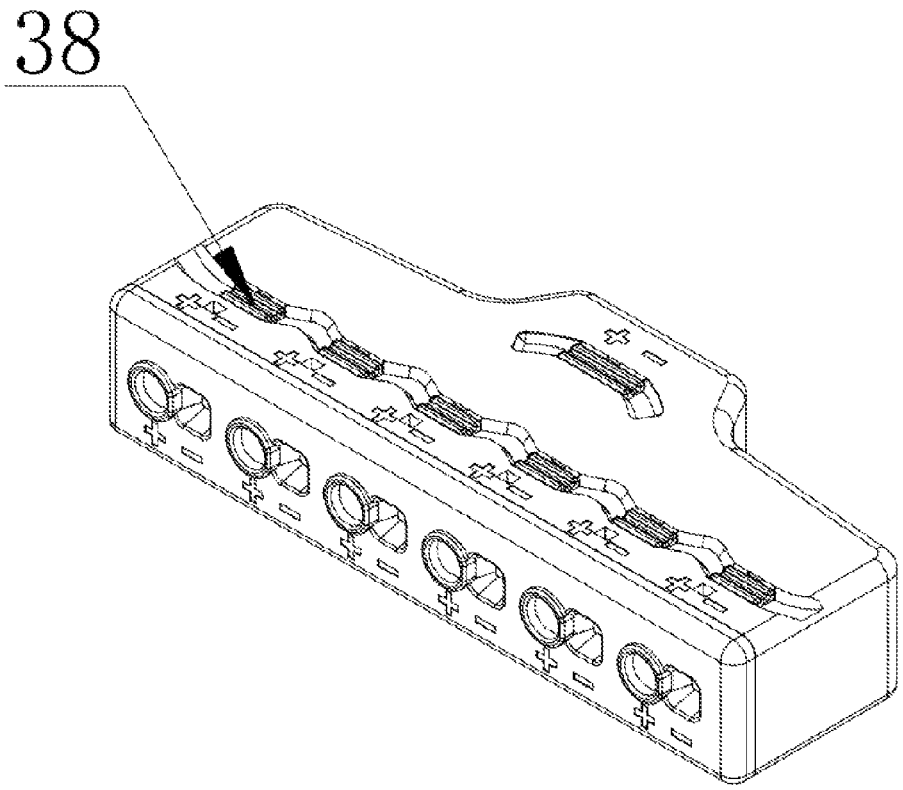
FIG. 22: Structure Diagram of A Terminal Block Splitter Connector in Embodiment 2 of the Invention
Figure 23:
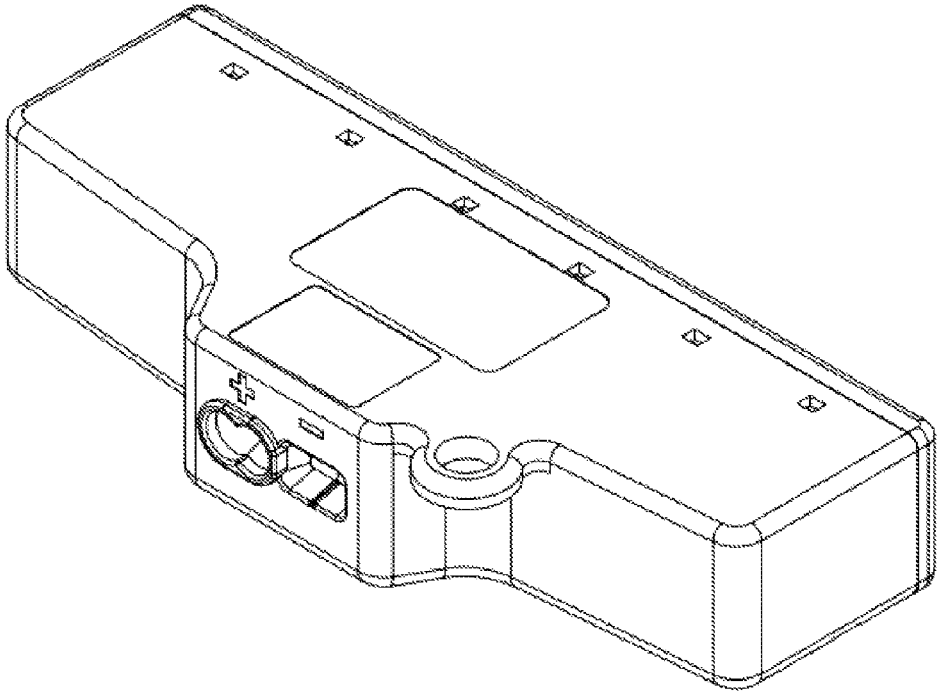
FIG. 23: Structure Diagram for Another Direction of A Terminal Block Splitter Connector in Embodiment 2 of the Invention
Figure 24:
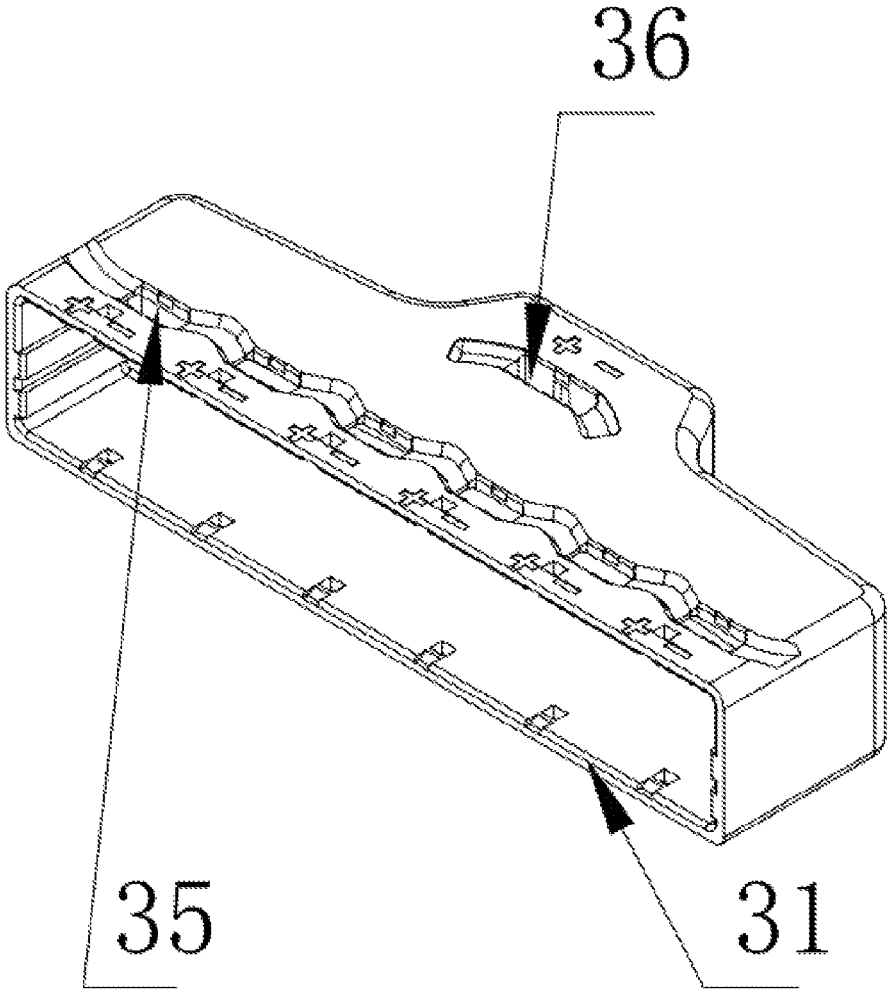
FIG. 24: Structure Diagram of Front Housing in Embodiment 2 of the Invention
Figure 25:
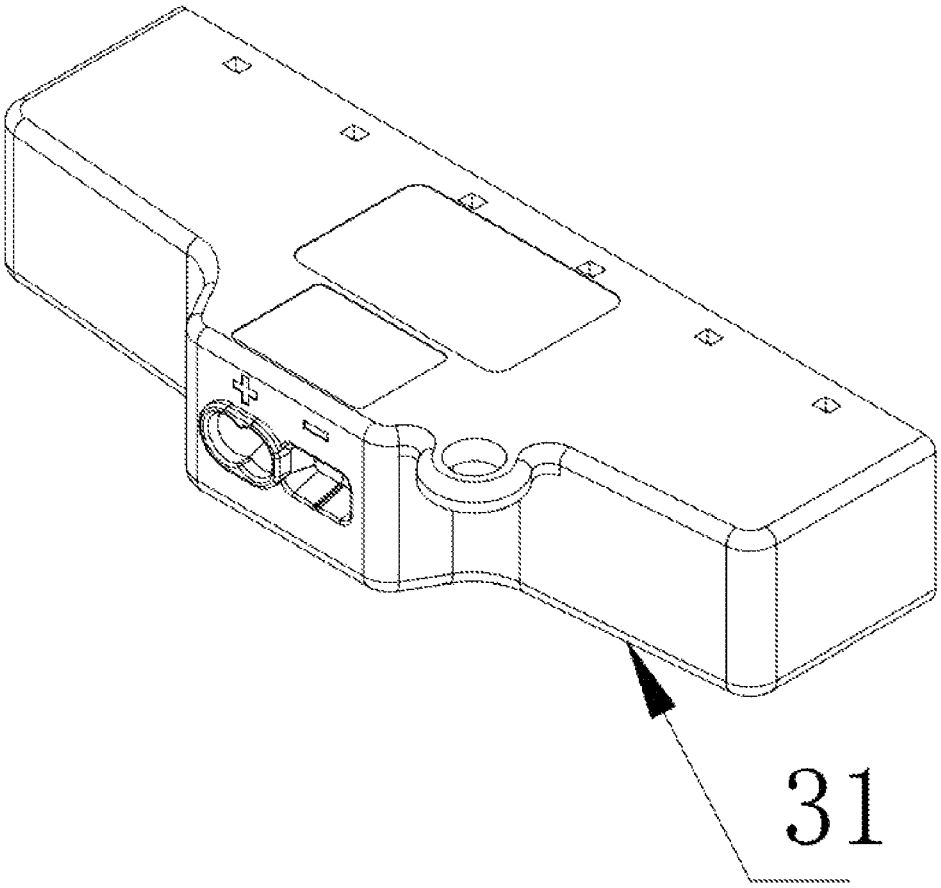
FIG. 25: Structure Diagram for Another Direction of Front Housing in Embodiment 2 of the Invention
Figure 26:
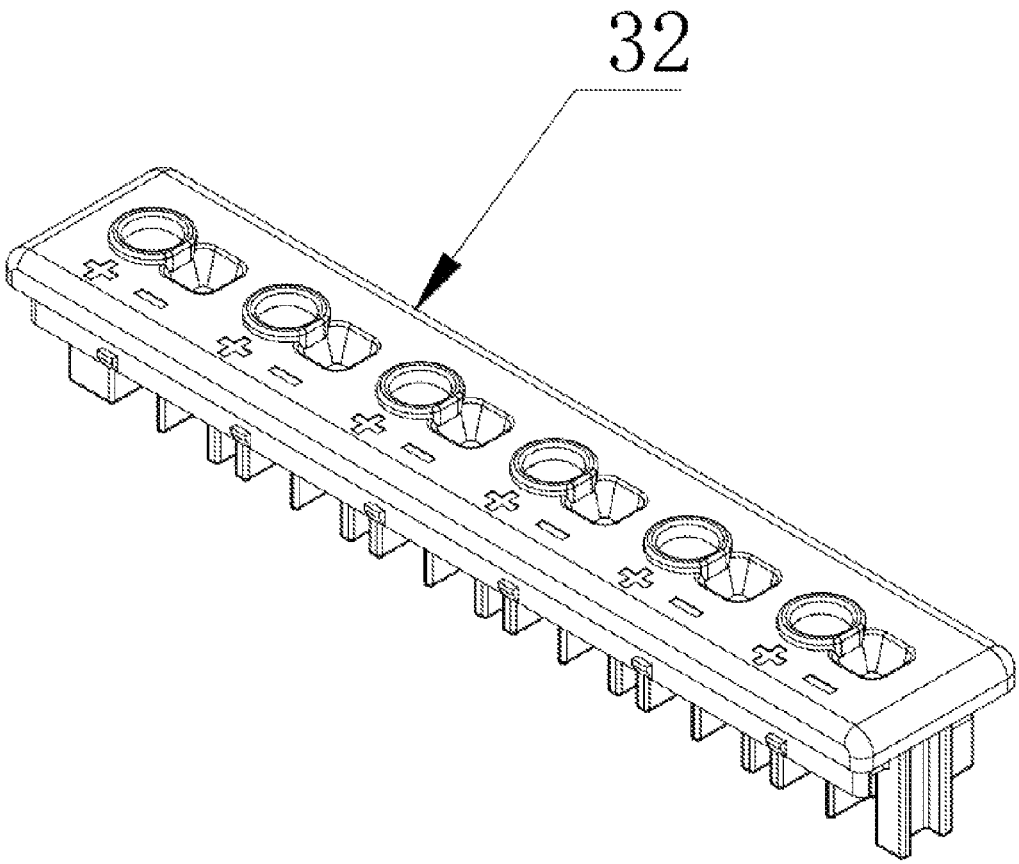
FIG. 26: Structure Diagram of Rear Housing in Embodiment 2 of the Invention
Figure 27:
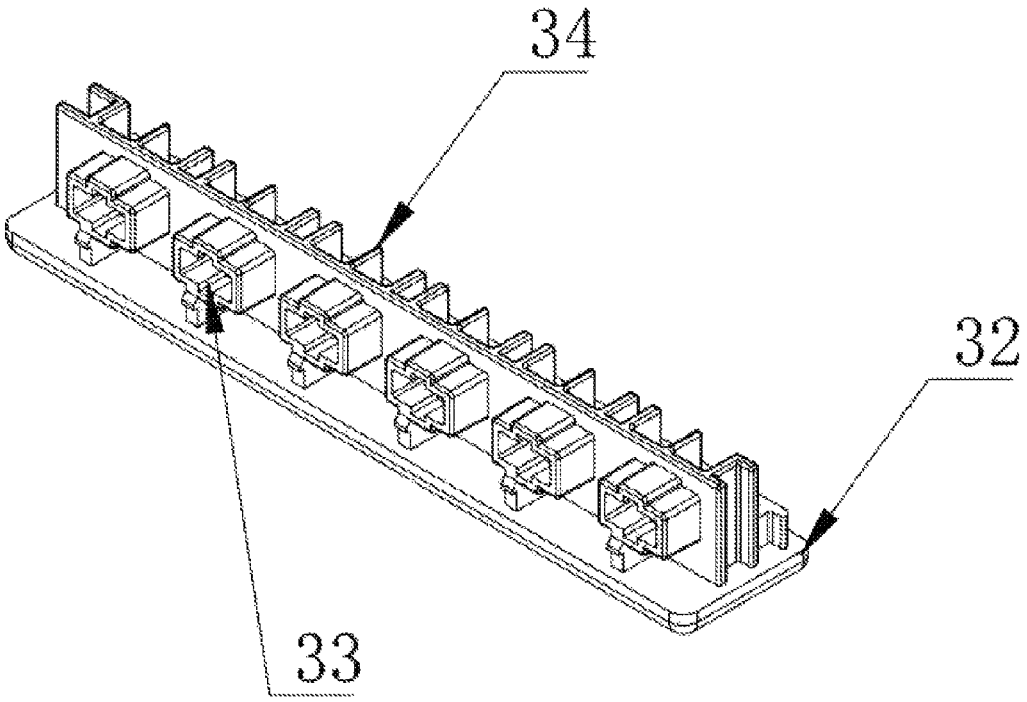
FIG. 27: Structure Diagram for Another Direction of Rear Housing in Embodiment 2 of the Invention
Figure 28:
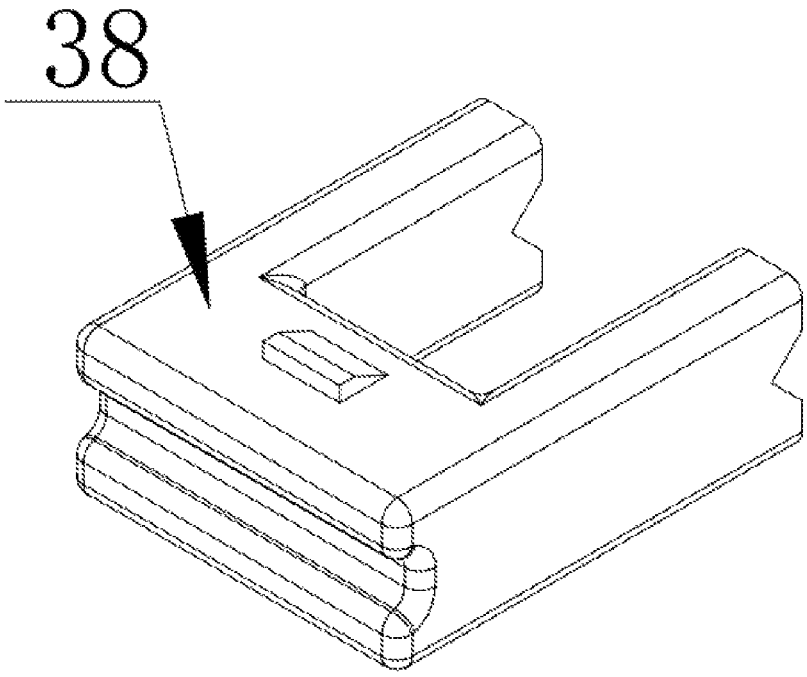
FIG. 28: Structure Diagram of Independent Button in Embodiment 2 of the Invention
Figure 29:
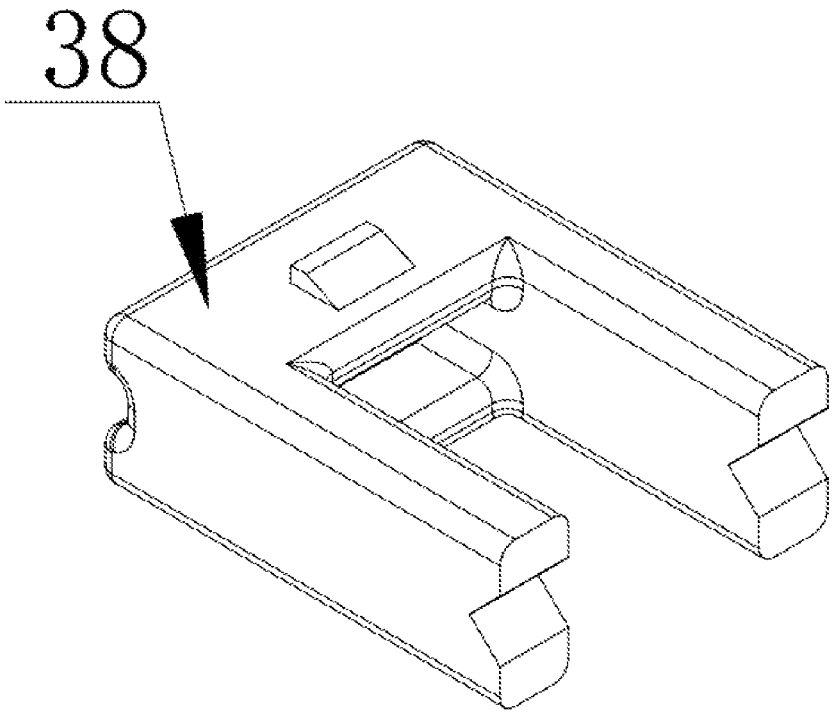
FIG. 29: Structure Diagram for Another Direction of Independent Button in Embodiment 2 of the Invention
Figure 30:
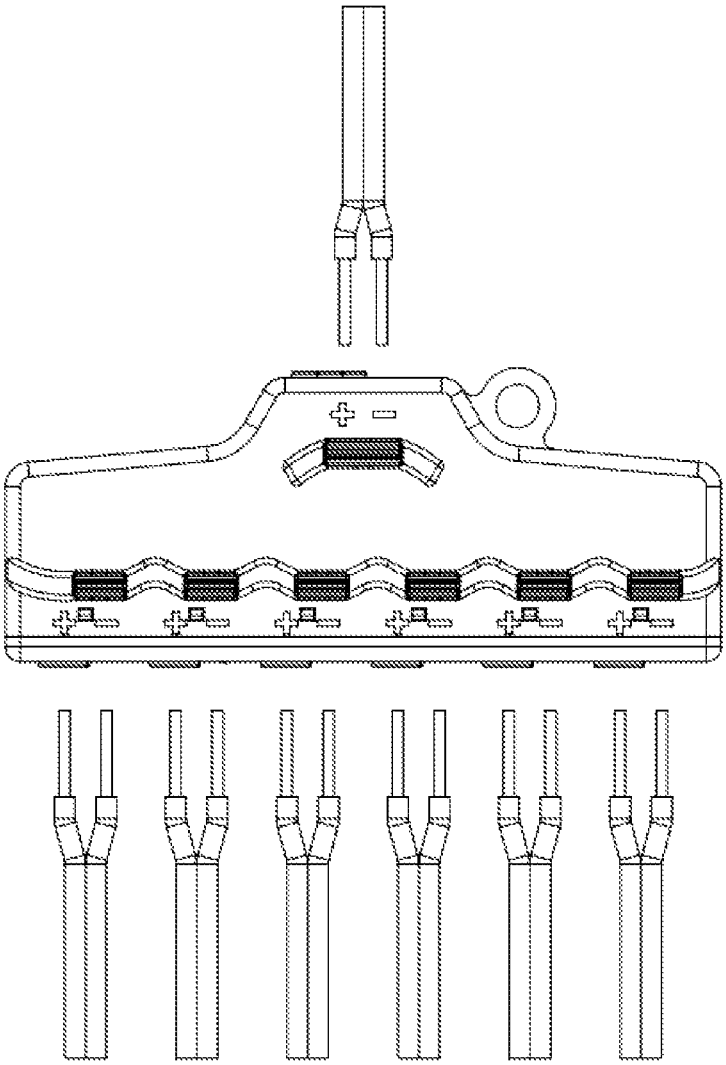
FIG. 30: Structure Diagram for Connecting A Terminal Block Splitter Connector with Wire in Embodiment 2 of the Invention
Figure 31:
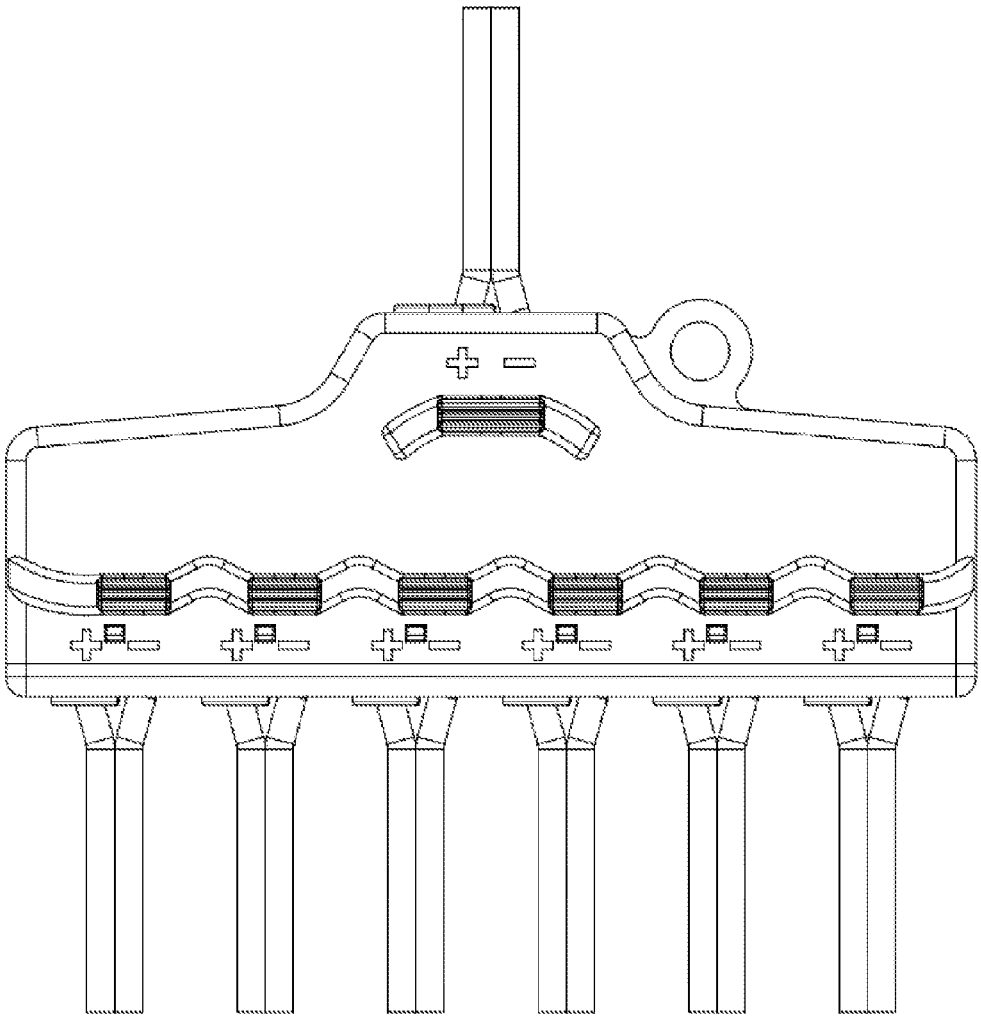
FIG. 31: Structure Diagram for Connected Terminal Block Splitter Connector and Wire in Embodiment 2 of the Invention

Embodiment 1 of the invention relates to a terminal block splitter connector as shown in FIGS. 1, 2, 3, 4, 5, 6, 7, 8, 9, 10, 11, 12, 13, 14, 15, 16, 17, 18, 19, and 20, including an insulating housing 1, and the first conductive metal component 2 and the second conductive metal component 3 installed in the insulating housing, wherein the insulating housing is equipped with the first fixing component 4 and the second fixing component 5 respectively for fixing the first and second conductive metal component. The first wire inlet group 6 is arranged on the front end of the insulating housing and corresponds to the first fixing component and the first conductive metal component. The second wire inlet group 7 is arranged on the rear end of the insulating housing and corresponds to the second fixing component and the second conductive metal component. The first push button 8 and the second push button 9 pass through the top end of the insulating housing and correspond to the first and second conductive metal component respectively. The first and second push button match with the first and second conductive metal component for on-line and off-line control of the first and second conductive metal component and the wire 37. There are 6 groups of the first conductive metal components and 1 group of the second conductive metal component. A conductive connection plate 10 is installed on the bottom of the insulating housing for power connection of the first and second conductive metal component. The first pin group 11 and the second pin group 12 are respectively mounted on the bottom of the first and second conductive metal component. The first socket group 13 and the second socket group 14 are installed on the conductive connection plate and respectively correspond to the first and second pin group. An anti-reverse installation structure 15 is arranged on both sides or front or rear end of the conductive connection plate for anti-reverse installation.

As an anti-reverse connection plate 16 to connect the first socket group with the second socket group, the anti-reverse installation structure should take different shapes on both sides for anti-reverse installation.

One side of the anti-reverse connection plate is tilt and the other of which is straight.

The first conductive metal component is composed of two of the first metal frames 17 which are symmetrical and arranged side-by-side. The first metal frame is hollow. One end of the first metal frame corresponding to the first wire inlet group is equipped with the first elastic metal sheet 18 which is up from bottom and turned over in the first metal frame to be closely attached with the top end of the first metal frame. The first gap 19 mounted on the top end of the first metal frame allows the pressing end of the first push button to be passed and is able to press the first elastic metal sheet down. The second conductive metal component is composed of two of the second metal frames 20 which are symmetrical and arranged side-by-side. The second metal frame is hollow. One end of the second metal frame corresponding to the second wire inlet group is equipped with the second elastic metal sheet 21 which is up from bottom and turned over in the second metal frame to be closely attached with the top end of the second metal frame. The second gap 22 mounted on the top end of the second metal frame allows the pressing end of the second push button to be passed and is able to press the second elastic metal sheet down. The first pin group consists of the first pins 23 respectively mounted on two of the first metal frame groups. Two of the first pins are installed on the bottom of each the first metal frame group. The first pin and the first metal frame group are integrated. The second pin group consists of the second pins 24 respectively mounted on two of the second metal frame groups. Two of the second pins are installed on the bottom of each the second metal frame group. The second pin and the second metal frame group are integrated.

The insulating housing consists of upper housing 25 and lower housing 26. The conductive connection plate, the first and second fixing component are installed in the lower housing. The first and second push button are arranged on and integrated with the upper housing. The first and second push button and the insulating housing are combined into a flexible built-in button structure. The first fixing component consists of two of the first card boards 27, a rectangular slot block 28, and the second card boards 29. The first card boards are respectively arranged on both sides and erected to separate two of symmetrically side-by-side the first metal frames without direct contact. The rectangular slot block is gradually moving closer to the center from two of the first card boards on both sides and is sequentially staggered at intervals. Two rectangular slot blocks and the second card boards between them are to separate symmetrically side-by-side the first metal frame without direct contact. The second fixing component consists of three upright baffles 30 which separate symmetrically side-by-side the second metal frame without direct contact.

The conductive connection plate is powered in parallel or serial.

Embodiment 2

Embodiment 2 of the invention is changed on the basis of Embodiment 1, specifically reflected in different structures of the insulating housing, the first push button, and the second push button, as follows: As shown in FIGS. 21, 22, 23, 24, 25, 26, 27, 28, 29, 30, and 31, the insulating housing consists of front housing 31 and rear housing 32. Conductive connection plate and the second fixing component are arranged in the front housing. The first fixing component is arranged on the rear housing. The first fixing component is composed of the first straight slot 33 on the upper part and the first baffle 34 on the lower part. The first baffle is to separate two of symmetrically side-by-side the first metal frames without direct contact. The upper housing is equipped with the first button installation slot 35 corresponding to the first straight slot. The first push button passes through the first button installation slot and the first straight slot to press the first metal frame. The second fixing component is composed of the second straight slot on the upper part and the second baffle on the lower part. The second baffle is to separate two of symmetrically side-by-side the second metal frames without direct contact. The upper housing is equipped with the second button installation slot 36 corresponding to the second straight slot. The second push button passes through the second button installation slot and the second straight slot to press the second metal frame. The first and second push button and the upper housing is able to form an independently arranged or installed independent button 38. The first and second push button are inverted U-type and provided with two pressing ends downwards.

Embodiment 3

Figure 32:
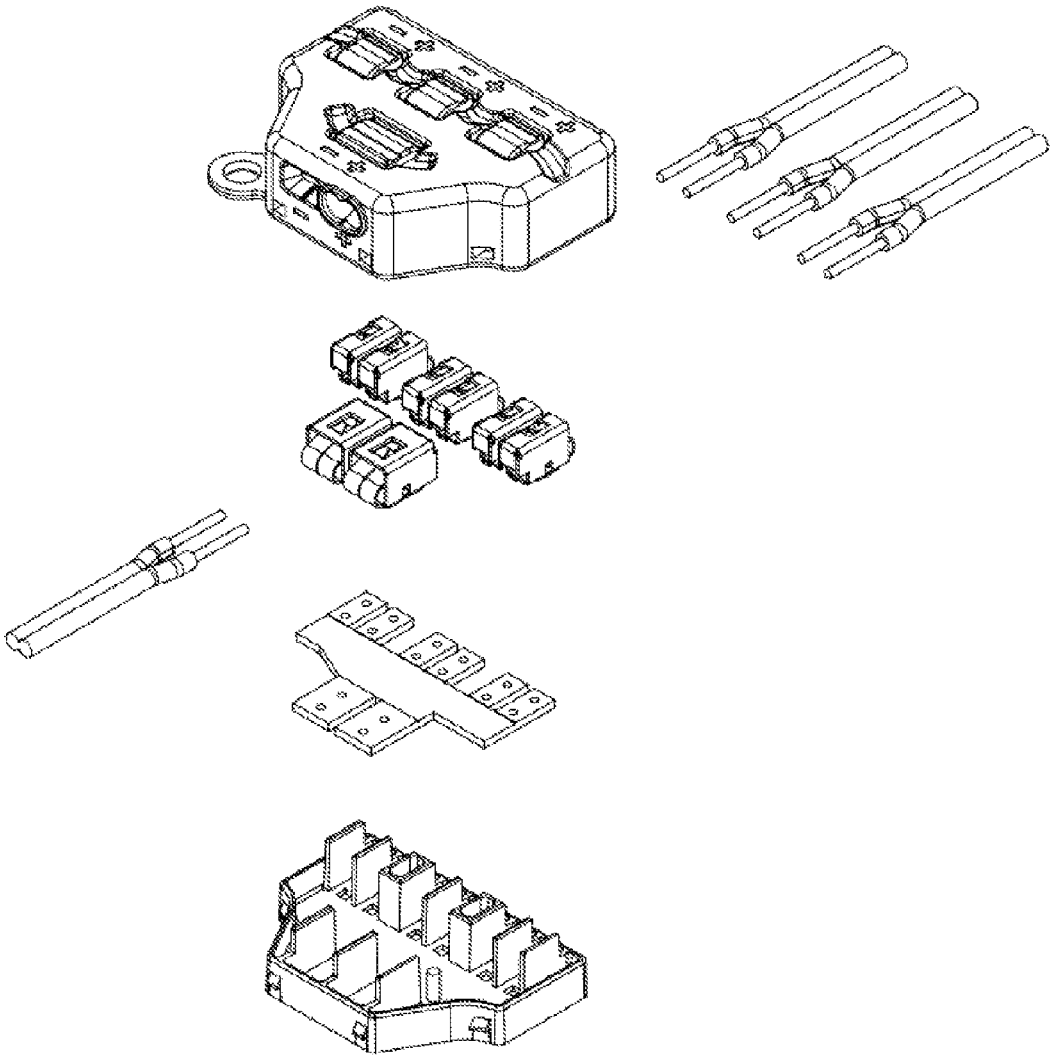
FIG. 32: Structure Decomposition Map for Connecting A Three-Dimensional Structure of Terminal Block Splitter Connector with Built-in Button to Wire in Embodiment 3 of the Invention
Figure 33:
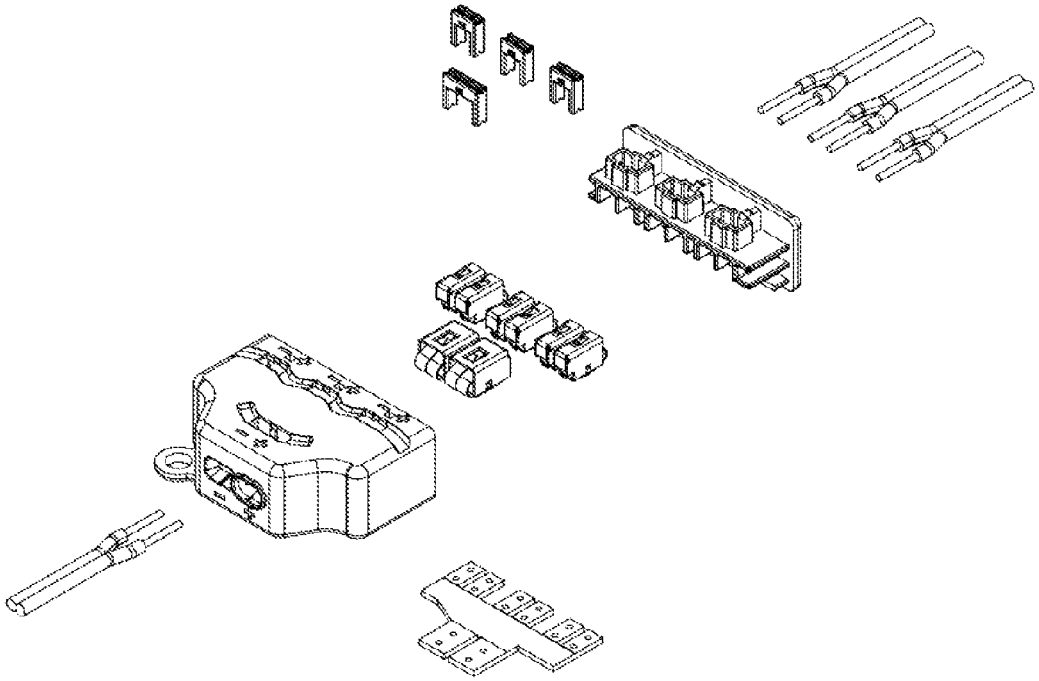
FIG. 33: Structure Decomposition Map for Connecting A Three-Dimensional Structure of Terminal Block Splitter Connector with Built-in Button to Wire in Embodiment 3 of the Invention

Embodiment 3 of the invention is changed on the basis of Embodiment 1 and 2, specifically reflected in different numbers of the first conductive metal components, as follows:

As shown in FIGS. 32 and 33, there are 3 groups of the first conductive metal components corresponding to different structures of the first wire inlet group and the insulating housing, namely, three-dimensional terminal block splitter connector with structures of built-in button and independent button.

Figure 34:
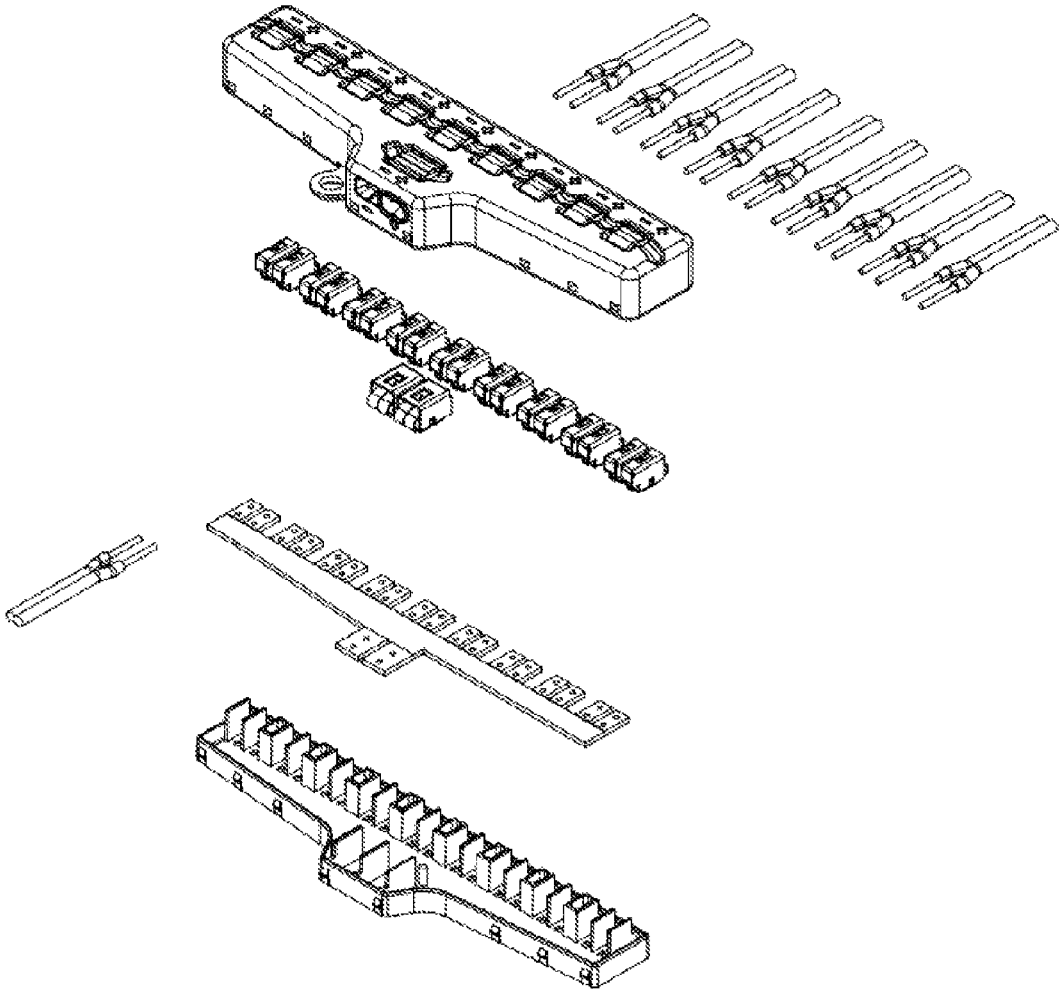
FIG. 34: Structure Decomposition Map for Connecting A Nine-Dimensional Structure of Terminal Block Splitter Connector with Built-in Button to Wire in Embodiment 3 of the Invention
Figure 35:
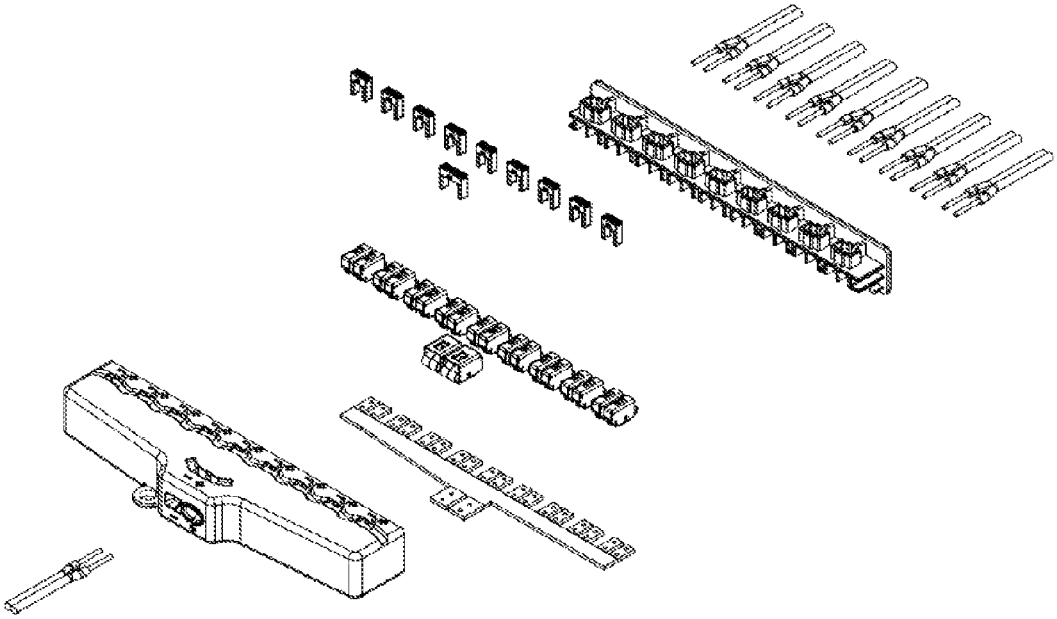
FIG. 35: Structure Decomposition Map for Connecting A Nine-Dimensional Structure of Terminal Block Splitter Connector with Built-in Button to Wire in Embodiment 3 of the Invention

As shown in FIGS. 34 and 35, there are 9 groups of the first conductive metal components corresponding to different structures of the first wire inlet group and the insulating housing, namely, nine-dimensional terminal block splitter connector with structures of built-in button and independent button.

The foregoing embodiments are only the preferred embodiment of the invention and make no restrictions to the technical contents of the invention in any forms. Any simple modification, equivalent change and modification for the above embodiments of the invention based on the technical contents still fall within the scope of the technical scheme of the invention.

What is claimed is:

1. A terminal block splitter connector including an insulating housing, and first and second conductive metal component installed in the insulating housing, wherein the insulating housing is equipped with first and second fixing component respectively for fixing the first and second conductive metal component, a first wire inlet group is arranged on the front end of the insulating housing and corresponds to the first fixing component and the first conductive metal component, a second wire inlet group is arranged on the rear end of the insulating housing and corresponds to the second fixing component and the second conductive metal component, first and second push button pass through the top end of the insulating housing and correspond to the first and second conductive metal component respectively, the first and second push button match with the first and second conductive metal component for on-line and off-line control of the first and second conductive metal component, there are at least 2 groups of the first conductive metal component and 1 group of the second conductive metal component, the features are as follows: a conductive connection plate is installed on the bottom of the insulating housing for power connection of the first and second conductive metal component, first and second pin group are respectively mounted on the bottom of the first and second conductive metal component, first and second socket group are installed on the conductive connection plate and respectively correspond to the first and second pin group, an anti-reverse installation structure is arranged on both sides or front or rear end of the conductive connection plate for anti-reverse installation.

2. The terminal block splitter connector according to claim 1, wherein as an anti-reverse connection plate to connect the first socket group with the second socket group, the anti-reverse installation structure should take different shapes on both sides for anti-reverse installation.

3. The terminal block splitter connector according to claim 2, wherein one side of the anti-reverse connection plate is tilt and the other of which is straight.

4. The terminal block splitter connector according to claim 3, wherein the first conductive metal component is composed of two first metal frames which are symmetrical and arranged side-by-side, the first metal frame is hollow, one end of the first metal frame corresponding to the first wire inlet group is equipped with a first elastic metal sheet which is up from bottom and turned over in the first metal frame to be closely attached with the top end of the first metal frame, a first gap mounted on the top end of the first metal frame allows the pressing end of the first push button to be passed and is able to press the first elastic metal sheet down, wherein the second conductive metal component is composed of two second metal frames which are symmetrical and arranged side-by-side, the second metal frame is hollow, one end of the second metal frame corresponding to the second wire inlet group is equipped with a second elastic metal sheet which is up from bottom and turned over in the second metal frame to be closely attached with the top end of the second metal frame, a second gap mounted on the top end of the second metal frame allows the pressing end of the second push button to be passed and is able to press the second elastic metal sheet down, the first pin group consists of first pins respectively mounted on two of the first metal frame groups, two of the first pins are installed on the bottom of each the first metal frame group, the first pin and the first metal frame group are integrated, the second pin group consists of second pins respectively mounted on two of the second metal frame groups, two of the second pins are installed on the bottom of each the second metal frame group, the second pin and the second metal frame group are integrated.

5. The terminal block splitter connector according to claim 4, wherein the insulating housing consists of upper housing and lower housing, the conductive connection plate, the first and second fixing component are installed in the lower housing, the first and second push button are arranged on and integrated with the upper housing, the first and second push button and the insulating housing are combined into a flexible built-in button structure, the first fixing component consists of two first card boards, a rectangular slot block, and second card boards, the first card boards are respectively arranged on both sides and erected to separate two of symmetrically side-by-side the first metal frames without direct contact, the rectangular slot block is gradually moving closer to the center from two of the first card boards on both sides and is sequentially staggered at intervals, two rectangular slot blocks and the second card boards between them are to separate symmetrically side-by-side the first metal frame without direct contact, the second fixing component consists of three upright baffles which separate symmetrically side-by-side the second metal frame without direct contact.

6. The terminal block splitter connector according to claim 4, wherein the insulating housing consists of front housing and rear housing, the conductive connection plate and the second fixing component are arranged in the front housing, the first fixing component is arranged on the rear housing, the first fixing component is composed of a first straight slot on the upper part and a first baffle on the lower part, the first baffle is to separate two of symmetrically side-by-side the first metal frames without direct contact, the upper housing is equipped with a first button installation slot corresponding to the first straight slot, the first push button passes through the first button installation slot and the first straight slot to press the first metal frame, the second fixing component is composed of a second straight slot on the upper part and a second baffle on the lower part, the second baffle is to separate two of symmetrically side-by-side the second metal frames without direct contact, the upper housing is equipped with a second button installation slot corresponding to the second straight slot, the second push button passes through the second button installation slot and the second straight slot to press the second metal frame, the first and second push button and the upper housing is able to form an independently arranged or installed independent button, the first and second push button are inverted U-type and provided with two pressing ends downwards.

7. The terminal block splitter connector according to any of claims 1 to 6, wherein the conductive connection plate is powered in parallel or serial.

8. Terminal block splitter connector according to claim 7, wherein there are 3, 6, or 9 groups of the first conductive metal components and 1 group of the second conductive metal component.

* * * * *